US008578864B2

(12) United States Patent
Nyenhuis et al.

(10) Patent No.: US 8,578,864 B2
(45) Date of Patent: Nov. 12, 2013

(54) REMOVABLE ATTACHMENT BAR FOR A FLIP-TOP TABLE

(75) Inventors: Jack Nyenhuis, Jenison, MI (US); Matthew Ruster, Holland, MI (US); Tod Babick, Grand Rapids, MI (US); Gary Petertyl, East Grand Rapids, MI (US); Bradley DeBruyne, Walker, MI (US)

(73) Assignee: DSA International, Inc., Zeeland, MI (US)

( * ) Notice: Subject to any disclaimer, the term of this patent is extended or adjusted under 35 U.S.C. 154(b) by 399 days.

(21) Appl. No.: 13/020,921

(22) Filed: Feb. 4, 2011

(65) Prior Publication Data

US 2011/0121147 A1 May 26, 2011

Related U.S. Application Data

(63) Continuation-in-part of application No. 12/031,009, filed on Feb. 14, 2008, now Pat. No. 8,171,863.

(51) Int. Cl.
*A47B 3/00* (2006.01)

(52) U.S. Cl.
USPC ..... 108/115

(58) Field of Classification Search
USPC ..... 108/115, 150, 125, 127, 124, 128, 129, 108/131, 132, 133, 134; 248/188.6, 188.1, 248/168, 170
See application file for complete search history.

(56) References Cited

U.S. PATENT DOCUMENTS

| | | | | |
|---|---|---|---|---|
| 6,845,723 | B2 * | 1/2005 | Kottman et al. | 108/132 |
| 7,066,098 | B2 * | 6/2006 | Blasen et al. | 108/115 |
| 7,703,400 | B2 * | 4/2010 | Mockel | 108/115 |
| 7,836,833 | B2 * | 11/2010 | Kumazawa | 108/115 |
| 7,878,128 | B2 * | 2/2011 | Watson et al. | 108/132 |
| 8,051,784 | B2 * | 11/2011 | Hsu | 108/115 |
| 8,051,785 | B2 * | 11/2011 | Lin | 108/115 |
| 8,069,795 | B1 * | 12/2011 | Williams et al. | 108/115 |
| 8,091,488 | B2 * | 1/2012 | Chirea et al. | 108/115 |
| 8,161,890 | B2 * | 4/2012 | Wang | 108/6 |
| 2004/0083932 | A1 * | 5/2004 | Kottman et al. | 108/115 |
| 2008/0295742 | A1 * | 12/2008 | Henriott | 108/6 |
| 2010/0258042 | A1 * | 10/2010 | Rutz | 108/115 |
| 2011/0139042 | A1 * | 6/2011 | Korb | 108/115 |
| 2011/0290159 | A1 * | 12/2011 | Saito | 108/115 |

* cited by examiner

*Primary Examiner* — Jose V Chen
(74) *Attorney, Agent, or Firm* — Taft Stettinius & Hollister LLP

(57) ABSTRACT

Disclosed is a removable attachment bar for a flip-top table that includes multiple tracks on which objects table top supports, storage containers, and other items may be mounted. While maintaining the benefits of standard flip-top tables, attachment bar also achieves many benefits including improved table rigidity and additional locations to secure attachments to the table.

20 Claims, 34 Drawing Sheets

FIG. 10
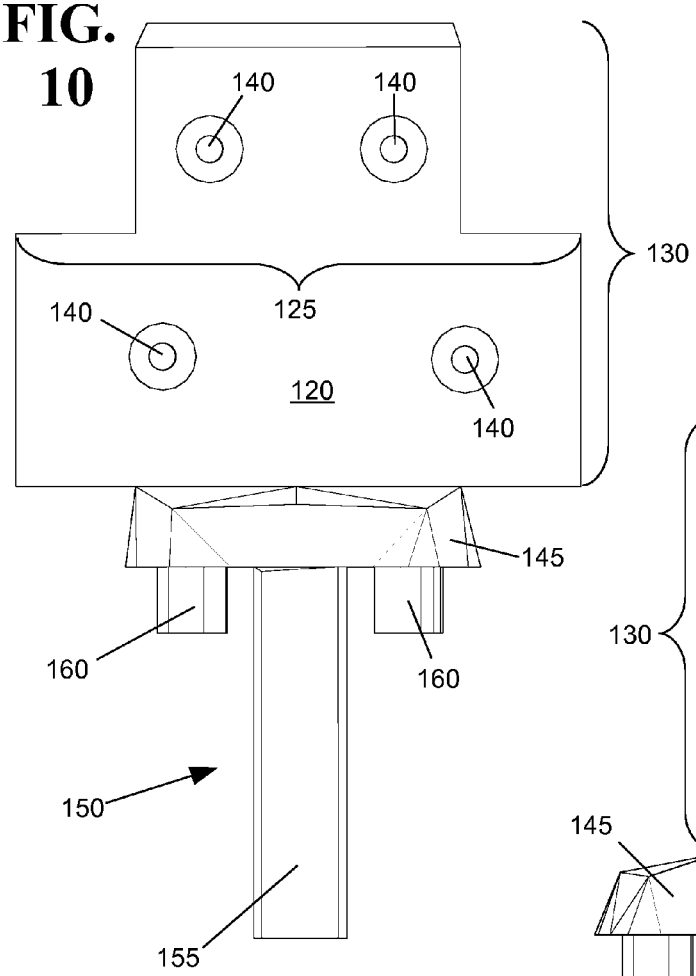
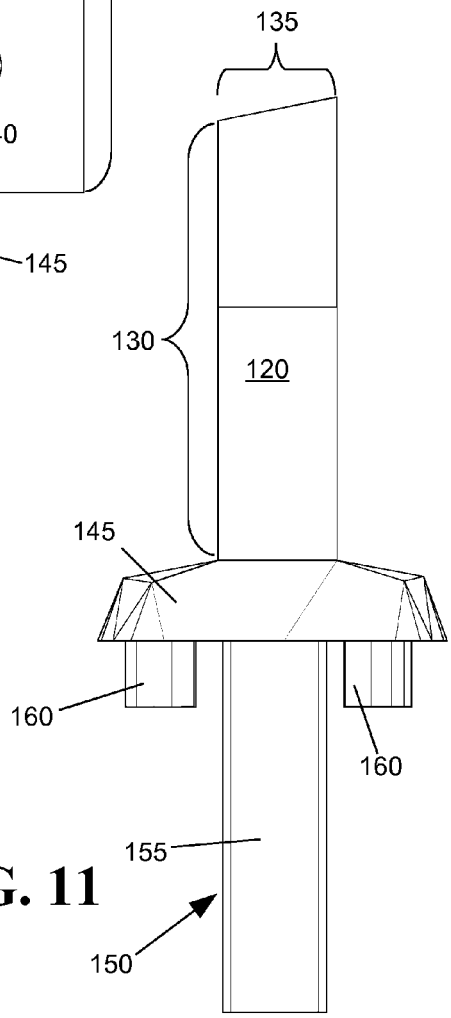
FIG. 11

FIG. 14
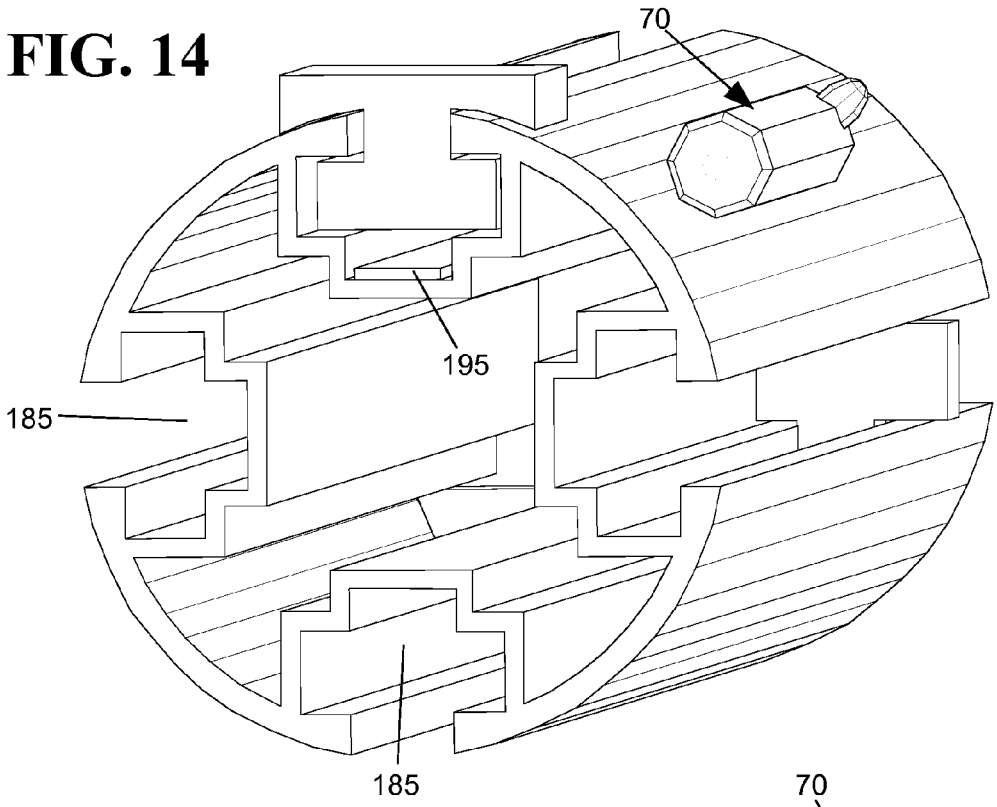
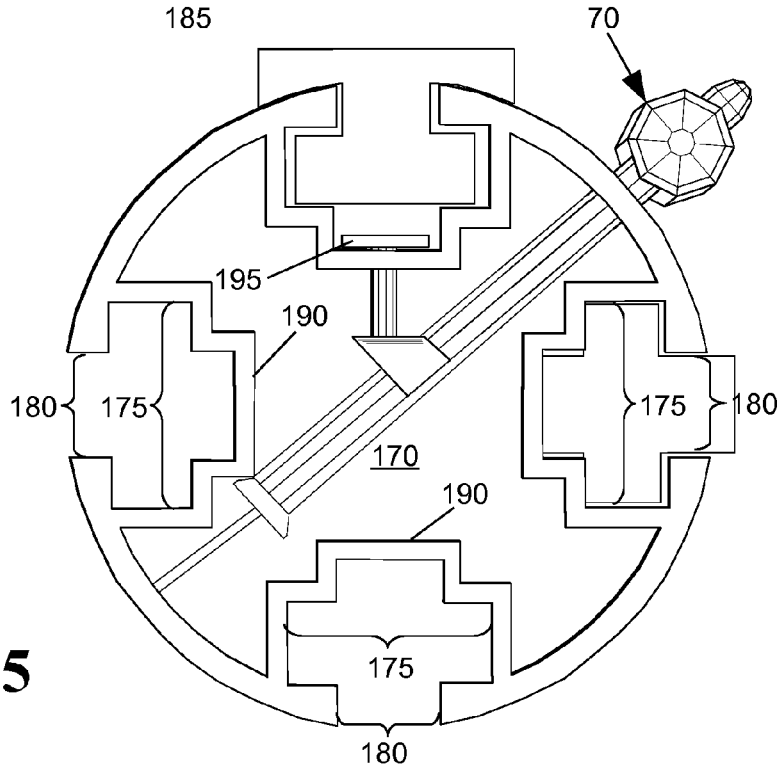
FIG. 15

FIG. 24
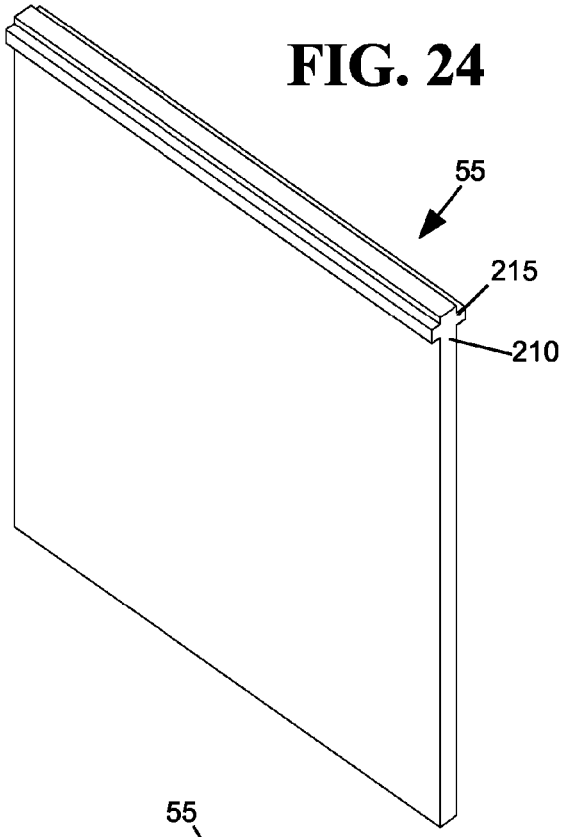
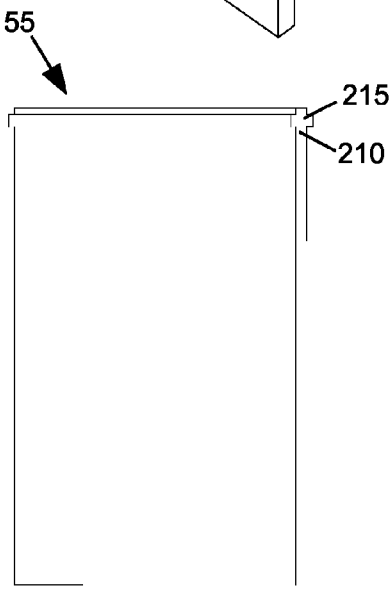
FIG. 25
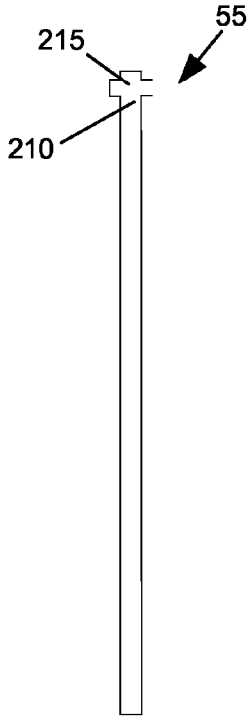
FIG. 26

REMOVABLE ATTACHMENT BAR FOR A FLIP-TOP TABLE

CROSS-REFERENCE TO RELATED APPLICATIONS

This application is a Continuation-in-Part of patent application Ser. No. 12/031,009 entitled "Flip-Top Table Mechanism" filed Feb. 14, 2008 now U.S. Pat. No. 8,171,863 by Jack Nyenhuis, Matthew Ruster, Tod Babick, Gary Petertyl, and Bradley DeBruyne, the entire contents of which are incorporated herein by reference.

FIELD OF THE INVENTION

The present invention relates generally to a flip-top table having a removable support and attachment bar between flip-top table mechanisms.

BACKGROUND OF THE INVENTION

Tables with tilting tops are well known in the art. Designers of flip-top tables, however, have faced many challenges in designing the mechanism that allows the top to tilt and preferably lock in place. First, the rigidity of a flip-top table must be comparable to conventional non-flip tables.

Second, the flip-top mechanisms must be simple to manufacture and preferably accommodate a variety of leg and table tops so that a single style of mechanism may be manufactured for multiple table designs.

Third, the flip-top mechanisms must provide sufficient support to the table top surface to prevent the table top from sagging when a load is placed on the table.

Fourth, when multiple flip-top mechanisms are used to support a table, it is desirable to have the distance between the mechanisms be adjustable so that various lengths of table tops may be supported by the mechanisms.

Fifth, pinch points at the location of mechanism activation must be minimized to reduce the risk of injury to the table operator. Sixth, the operation of the mechanism should be intuitive and a single or dual operation should be used for releasing the table top from multiple positions.

Seventh, it is desirable for the flip-top table system to be customizable with various attachments with a minimal amount of effort after the table has been delivered from the manufacturer to the customer.

Eighth, the mechanism must be difficult to accidentally activate when it is bumped or kicked by a person using the table. Ninth, the design of the mechanism must accommodate a modesty panel.

Finally, the mechanism should be constructed from lightweight yet robust materials. The mechanism should utilize unique latching features for each unique configuration because utilizing different portions of the mechanism helps to evenly spread the wear on the mechanism. Utilizing separate features for each latching position also allows the mechanical tolerances of the design and table wobble to be reduced. Additionally, separate features may be individually customized (strengthened, etc.) based on conditions the table will experience in a specific configuration.

There have been many attempts to address the challenges faced by designers of flip-top table mechanisms. For example, U.S. Pat. No. 1,203,783 issued to Reischmann and U.S. Pat. No. 3,641,946 issued to Charnay disclose lockable mechanisms for pivoting tables. The mechanisms have springs that are securable to a plurality of rods or holes, with each rod or hole corresponding to a unique table position. The '783 and '946 patents, however, do not provide unique spatially separated latching features since one spring interacts with all the rods or holes. Additionally, the latching mechanisms of the '738 and '946 patents are only functional with one type of table leg because the legs are integrated into the mechanisms, thus the need remains for an improved flip-top table mechanism.

U.S. Pat. No. 4,986,195 issued to Diffrient discloses a "tilting table top mechanism . . . [with] a chassis member which is secured to the underside of a table top and a base plate which is secured to the top of a table leg . . . . A dual locking mechanism maintains the table top in its normal 'use' position but is manually disengaged with ease." The mechanism of the '195 patent does not bi-directionally lock the rotation of the table in a folded configuration, thus the need remains for an improved flip-top table mechanism.

U.S. Pat. No. 3,796,169 issued to Bales and Estes discloses a flip-top table mechanism that utilizes unique portions of the latch for each configuration of the table. However, the mechanism of the '169 patent has several pinch points near the activation point of the mechanism.

U.S. Patent Application Publication 2009/0114130 by Chirea, et al. discloses a table top with a flip mechanism has a frame of two spaced apart legs, each leg having two pivoting wheels, a spine connecting each leg, and a table top hingedly connecting to the spine for rotation off the center of the table. However, the mechanism disclosed by Chirea is not adjustable in length and does not provide attachment points on the mechanism.

Accordingly, an object of the present invention is to provide an easily manufacturable mechanism for a flip-top table with rigidity comparable to a non flip-top table.

Another object of the present invention is to provide an intuitively operable mechanism that meets government and industry standards.

Yet another object of the present invention is to provide a flip-top table mechanism that is capable of locking a table in both a use and folded position.

Still another object of the present invention is to provide a mechanism having a removable attachment bar.

A still further object of the present invention is to provide a single release mechanism capable of releasing the table top from both a folded and a use position while being difficult to accidentally engage.

SUMMARY OF THE INVENTION

The present invention provides an attachment bar extending from flip-top table mechanisms. While maintaining the benefits of standard mechanisms, the mechanism of the present invention also achieves many benefits including improved table rigidity, an intuitively operable release mechanism, a single release action for both the "use" and "folded" positions, and spatially separated latches for the "use" and "folded" positions. Additionally the present invention provides a mechanism that meets or exceeds government and industry standards and has a refined appearance.

BRIEF DESCRIPTION OF THE DRAWINGS

FIG. 10 illustrates a top plan view of an attachment bracket.

FIG. 11 illustrates a side elevational view of an attachment bracket.

FIG. 14 illustrates a side perspective view of an attachment bar with an open clamping mechanism.

FIG. 15 illustrates a side elevational view of an attachment bar with an open clamping mechanism.

FIG. 24 shows a perspective view of a modesty panel adapted to be secured into an attachment bar extending between table legs.

FIG. 25 shows a side perspective view of a modesty panel adapted to be secured into an attachment bar extending between table legs.

FIG. 26 shows a front elevational view of a modesty panel adapted to be secured into an attachment bar extending between table legs.

DETAILED DESCRIPTION

Figure 1:
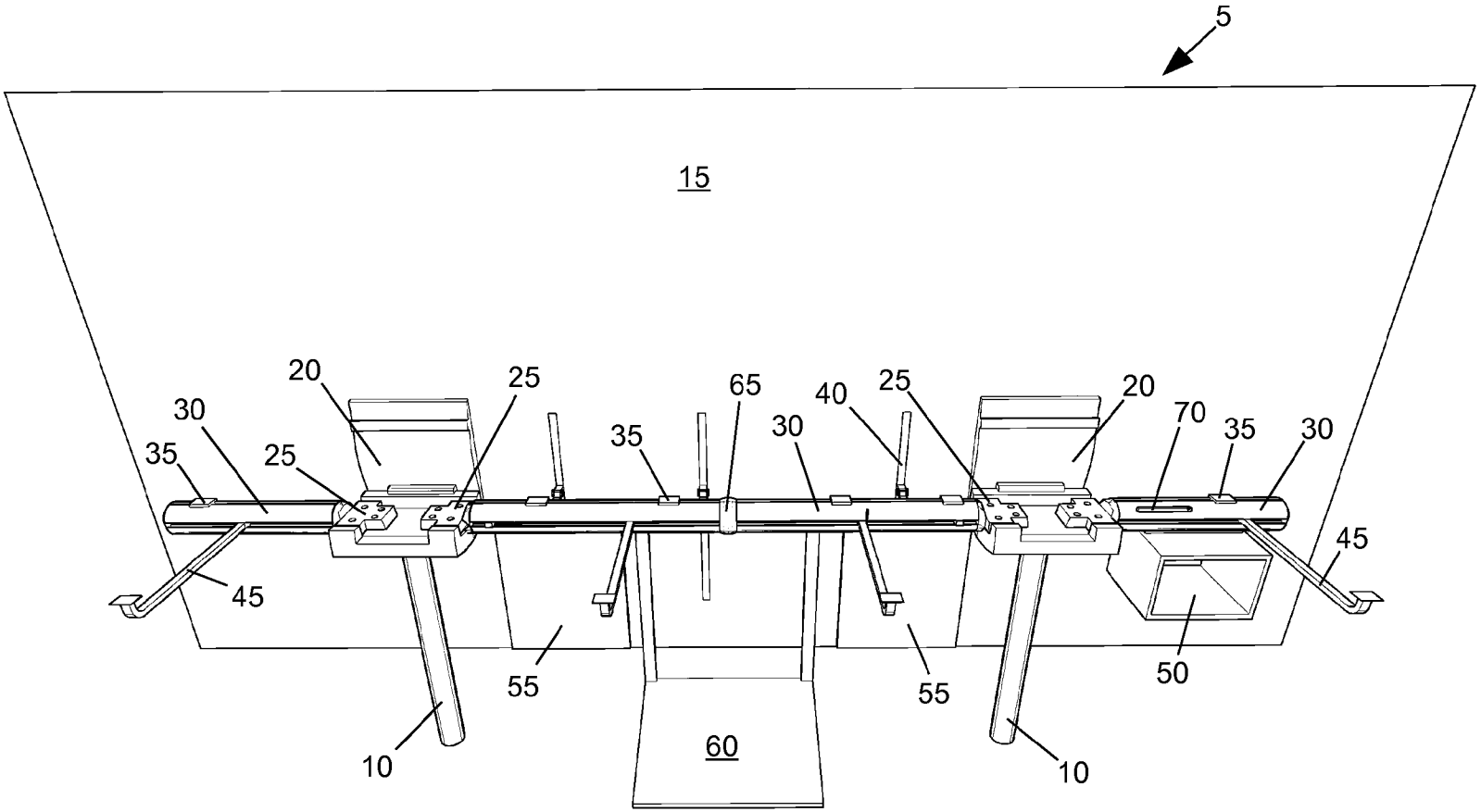
FIG. 1 illustrates an upper perspective view of a flip-top table with two table legs and multiple attachment bars secured to flip-top mechanisms.
Figure 2:
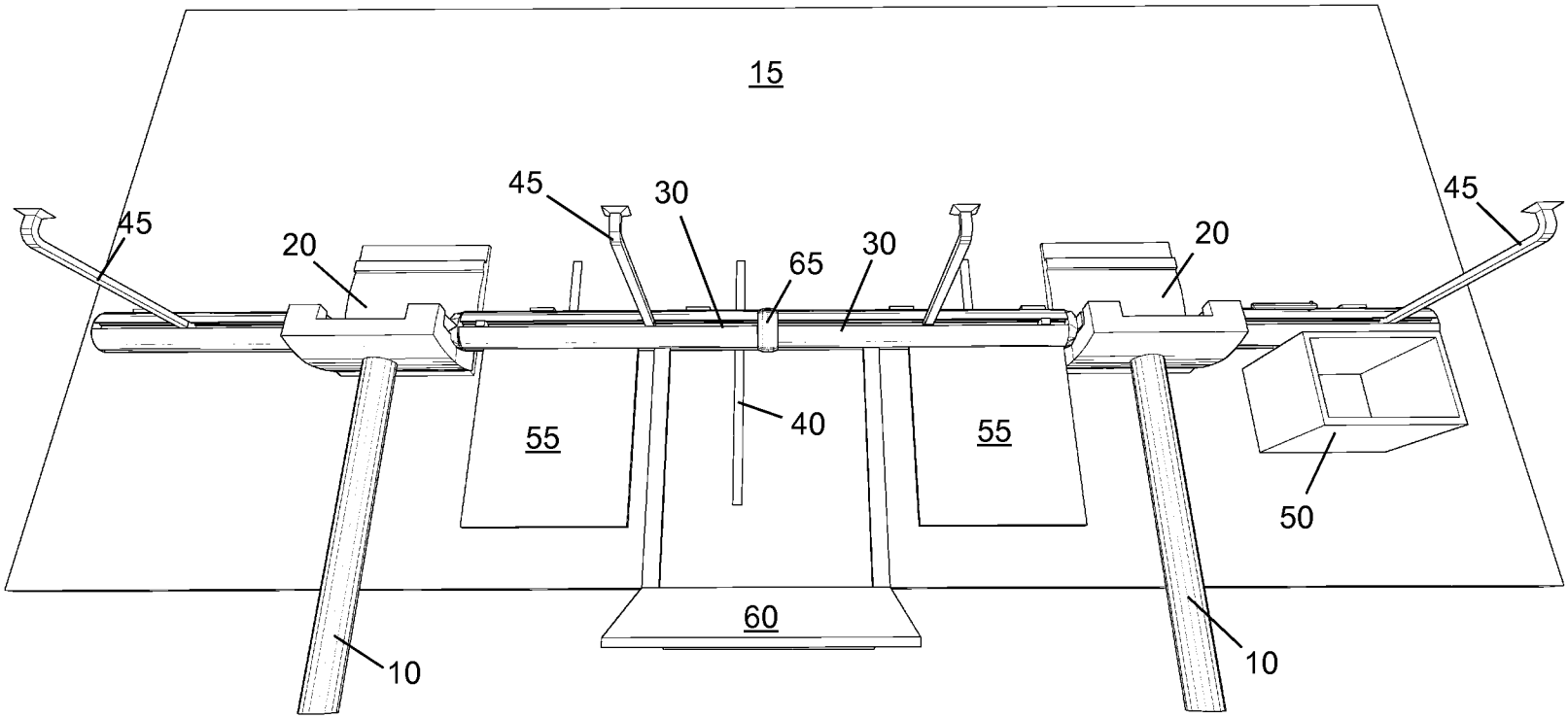
FIG. 2 illustrates a lower perspective view of a flip-top table with two table legs and multiple attachment bars secured to flip-top mechanisms.
Figure 3:
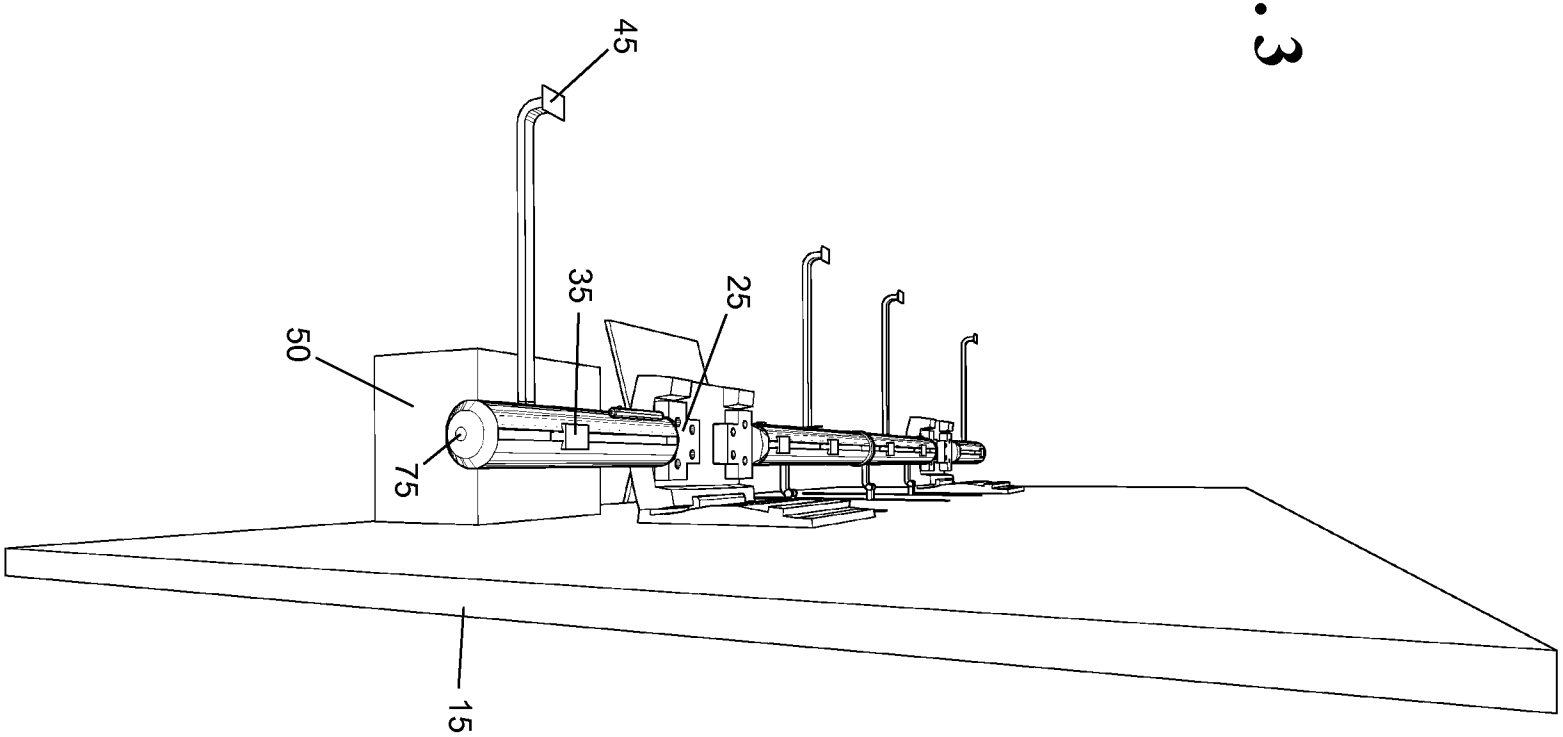
FIG. 3 illustrates a side perspective view of a flip-top table with two table legs and multiple attachment bars secured to flip-top mechanisms.
Figure 4:
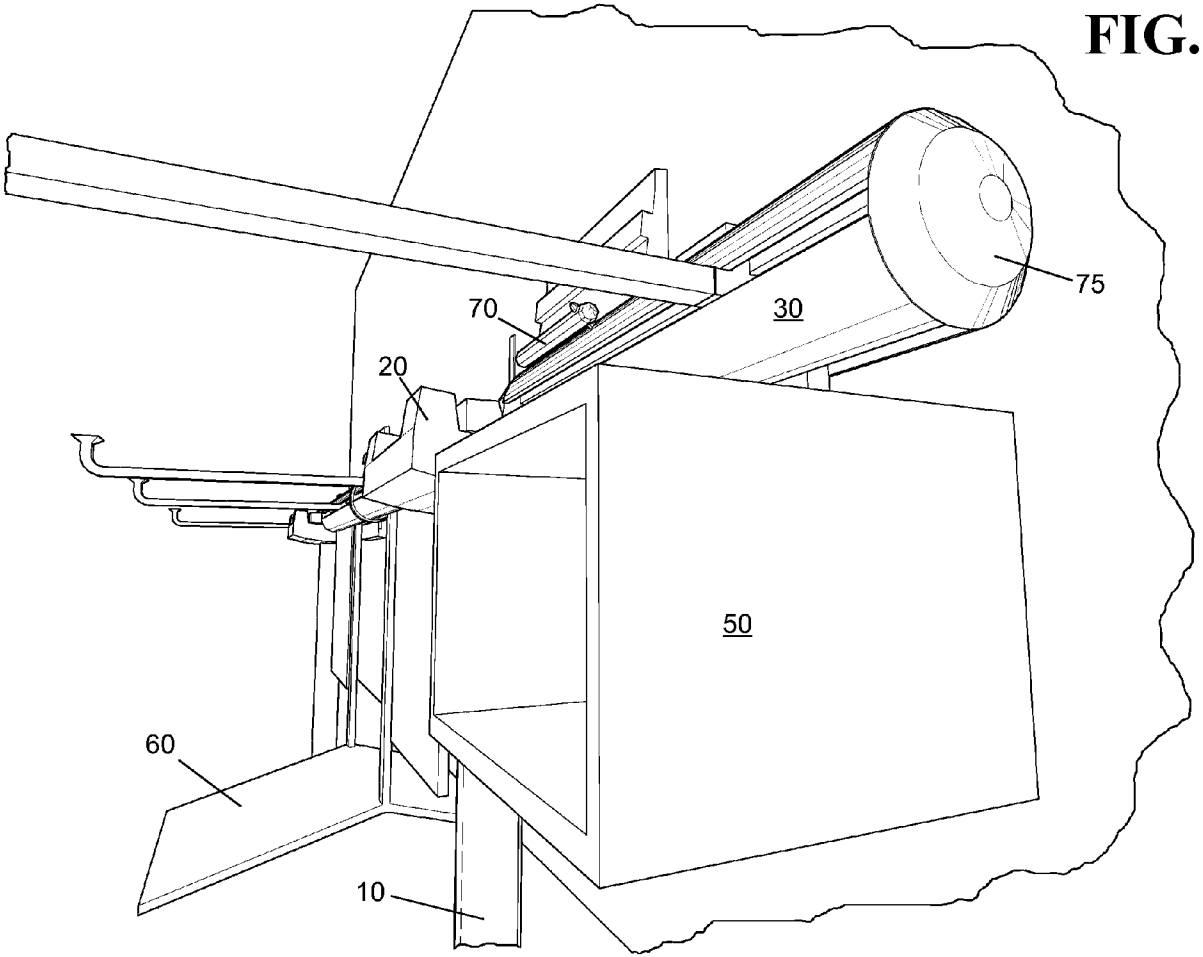
FIG. 4 illustrates a partial lower side perspective view of a flip-top table with two table legs and multiple attachment bars secured to flip-top mechanisms.
Figure 5A:
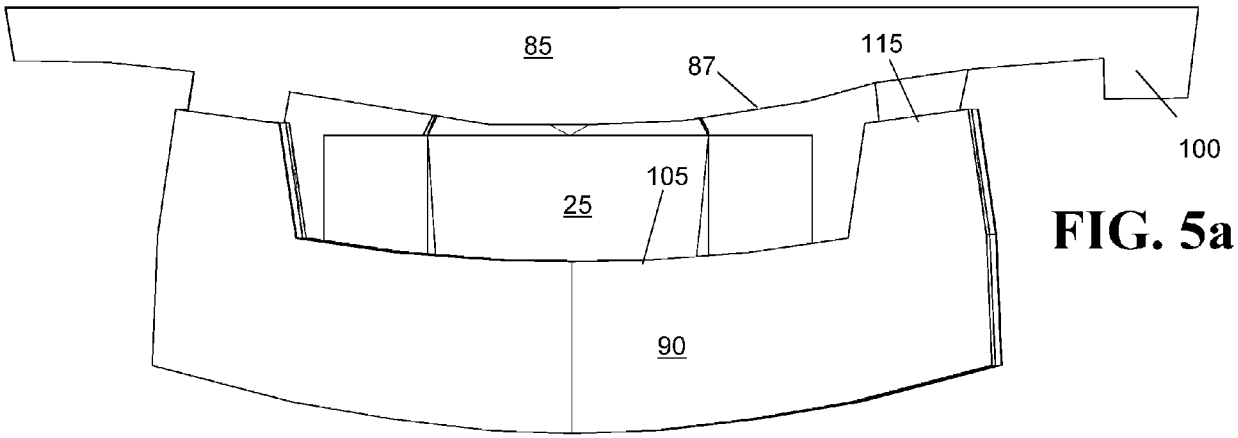
FIG. 5*a* illustrates a side elevational view of an attachment bracket secured to a flip-top table mechanism in a use configuration.
Figure 5B:
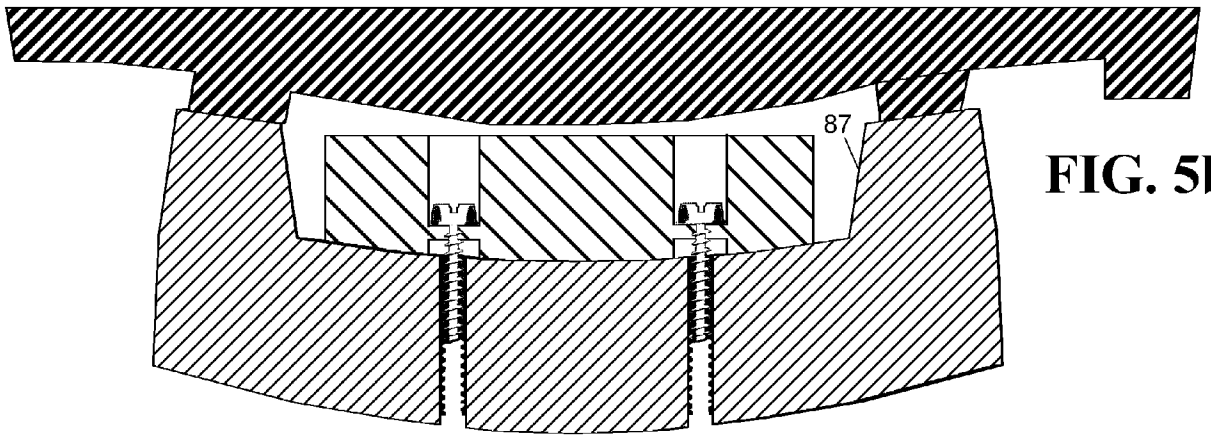
FIG. 5*b* illustrates a cross-sectional view of the attachment bracket and flip-top table mechanism of FIG. 5*a*.
Figure 6:
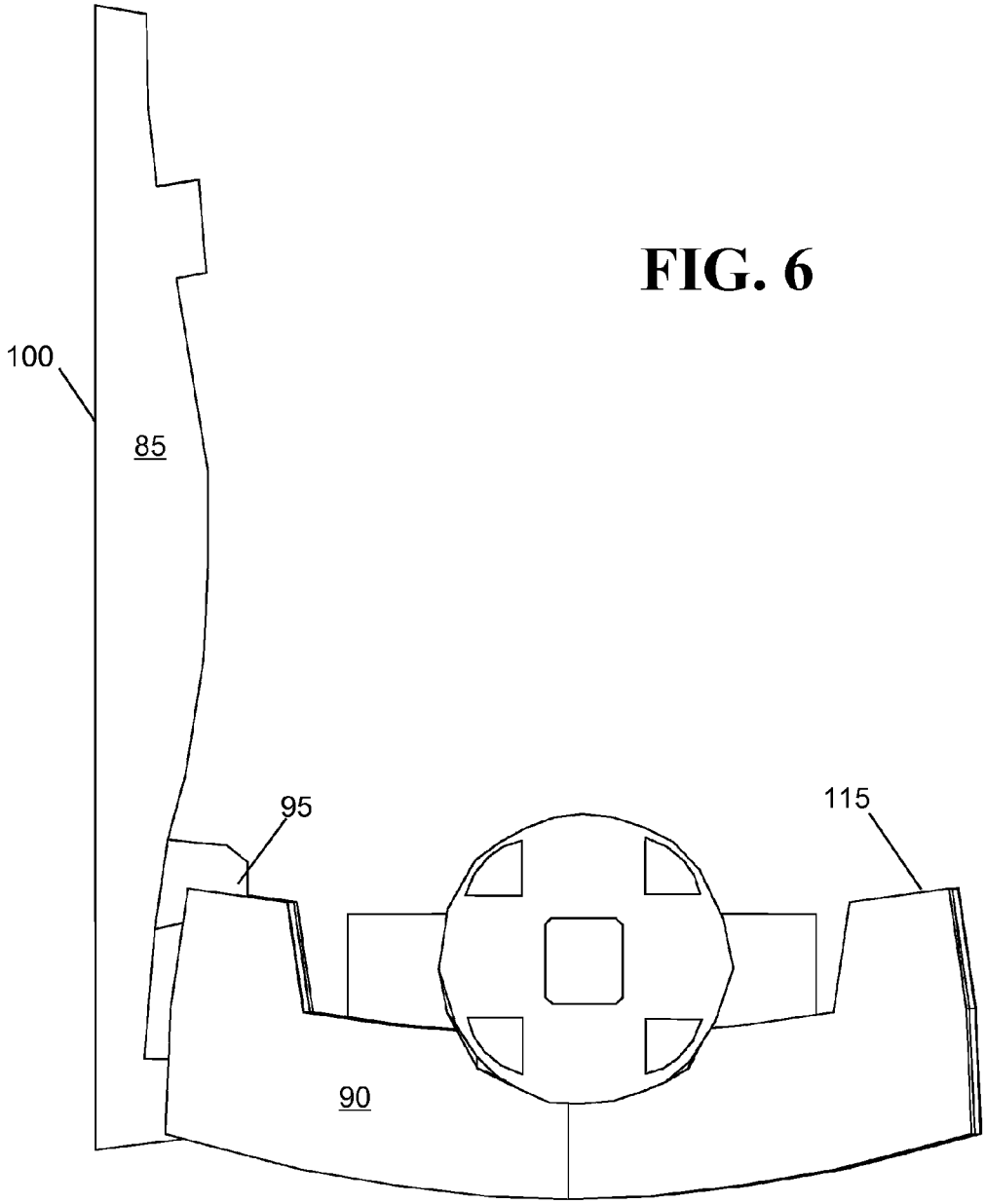
FIG. 6 illustrates a side elevational view of an attachment bracket secured to a flip-top table mechanism in a storage configuration.
Figure 7:
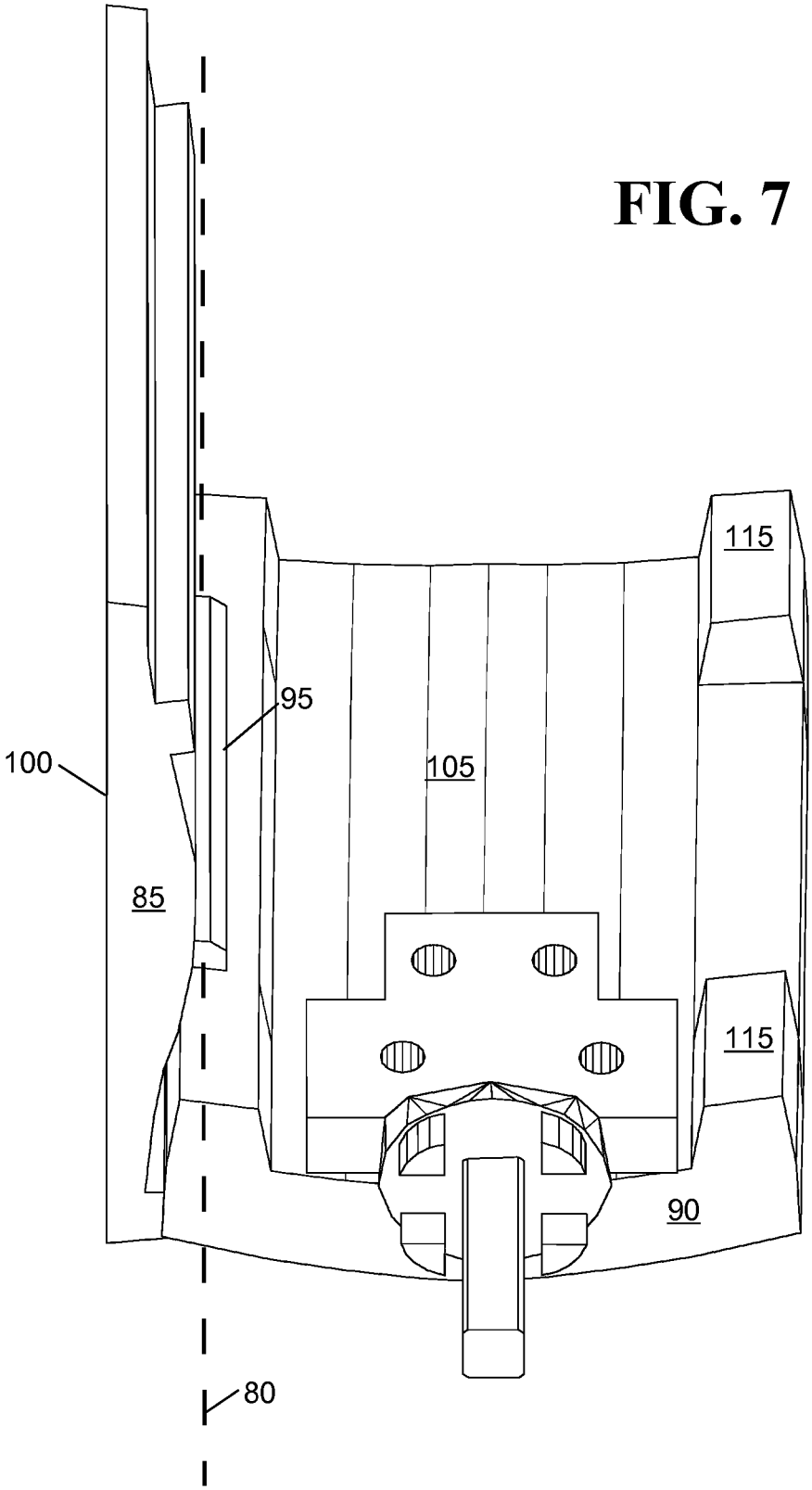
FIG. 7 illustrates an upper side perspective view of an attachment bracket secured to a flip-top table mechanism in a storage configuration.
Figure 8:
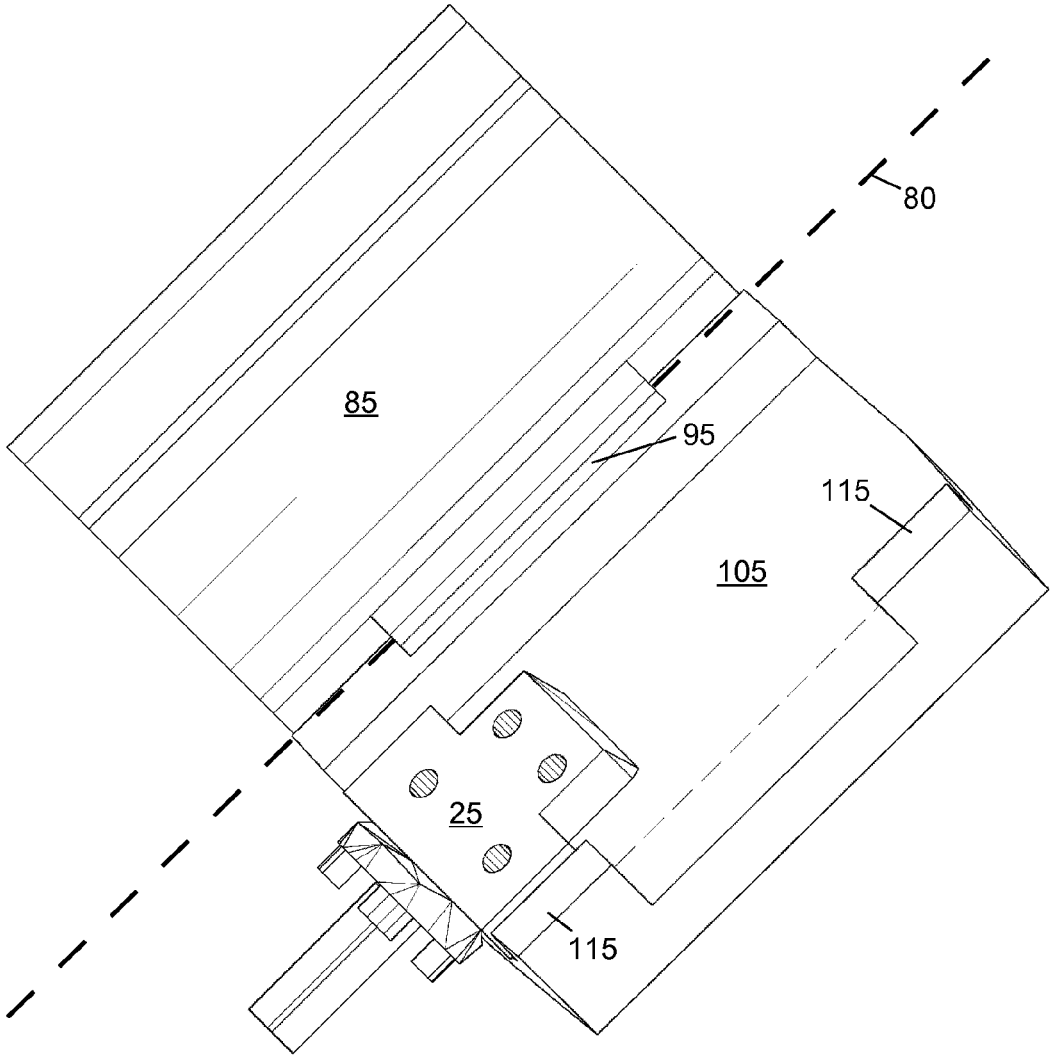
FIG. 8 illustrates a perspective view of an attachment bracket secured to a flip-top table mechanism in a storage configuration.
Figure 9:
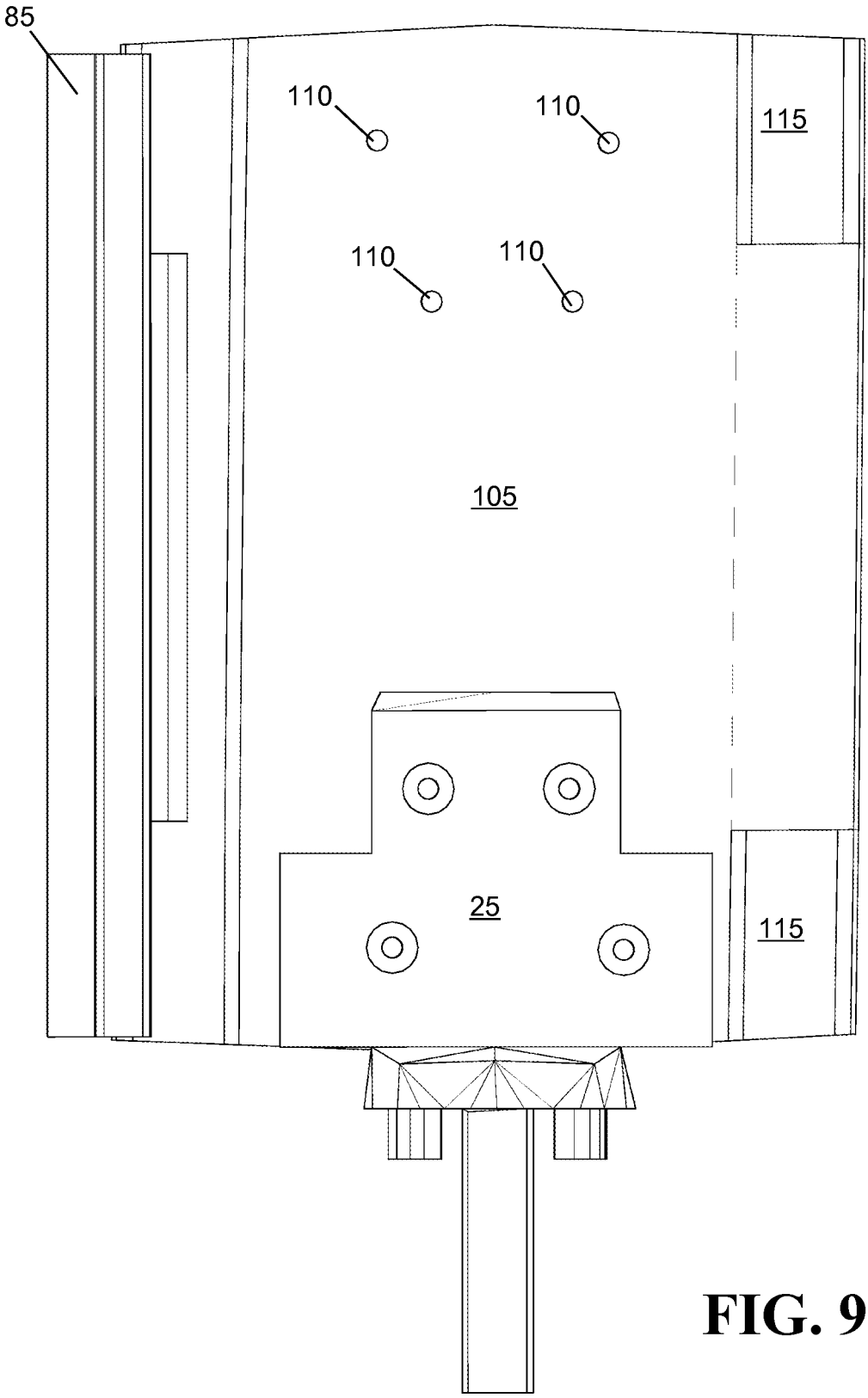
FIG. 9 illustrates a top plan view of an attachment bracket secured to a flip-top table mechanism in a storage configuration.
Figure 12:
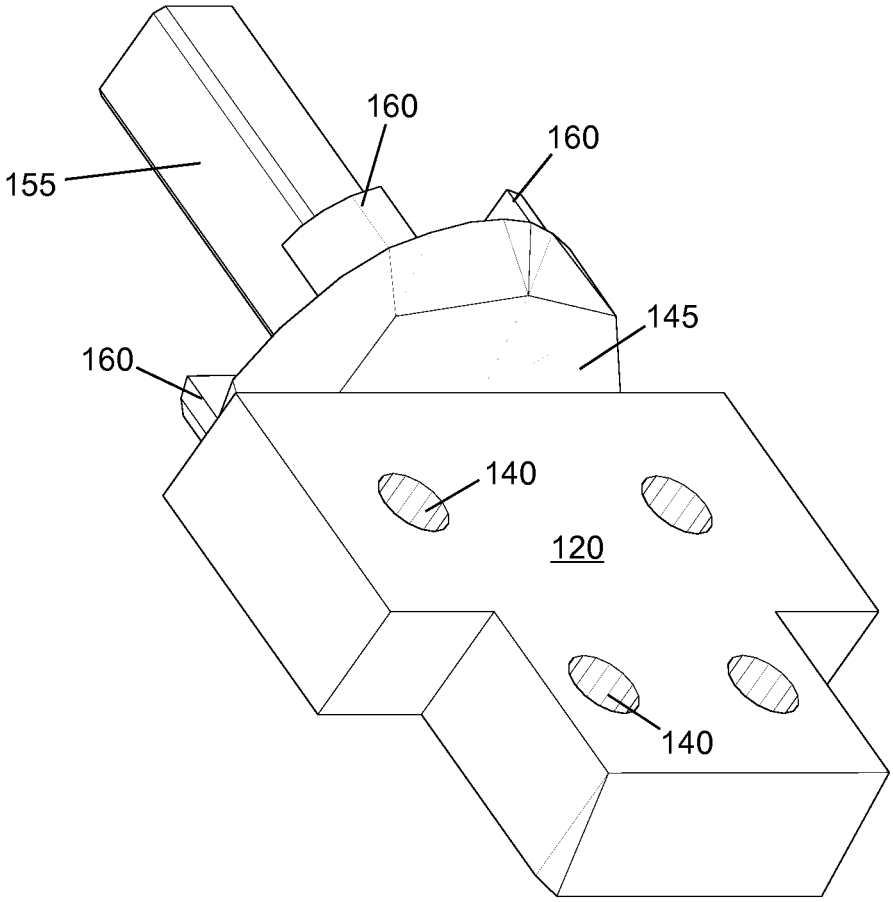
FIG. 12 illustrates a front perspective view of an attachment bracket.
Figure 13:
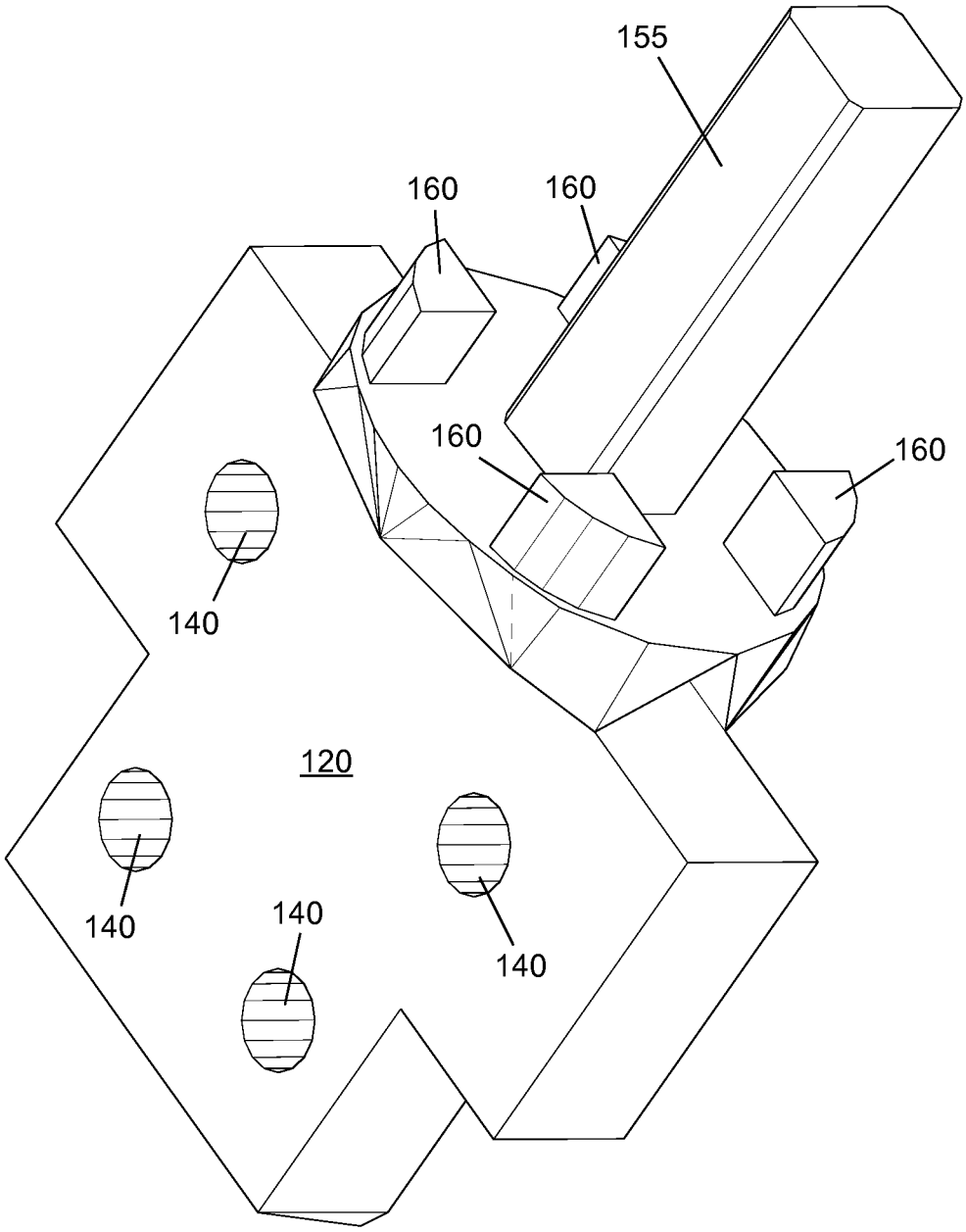
FIG. 13 illustrates a rear perspective view of an attachment bracket.

The present invention may be used with any type of table structure and is particularly suited for applications requiring a lightweight, rigid, and robust mechanism. The attachment bar may be used with objects such as chairs, tables, stadium seating or benches. However, for descriptive purposes, the present invention will be described in use with a flip-top table.

FIGS. 1 through 4 illustrate a flip-top table 5 having two table legs 10 secured to a table top 15 via two flip-top mechanisms 20. Removable attachment brackets 25 are secured to the flip-top mechanisms and attachment bars 30 connect to the attachment brackets. Some of the attachment bars extend between two flip-top mechanisms 20 while others extend away from single flip-top mechanisms. The attachment bars 30 are removable and provide additional rigidity to the support structure of the table. The addition of an attachment bar between flip-top mechanisms may increase the allowed spacing between legs and may allow the flip-top mechanisms to support a larger table top surface than would be possible without the attachment bar.

In addition to increasing the rigidity of the table, the attachment bars include slots configured to secure a plurality of attachments to the bar. The additional attachments may include a top support 35 configured to support the table top surface directly above the attachment bar. Proximate side supports 40 and distant side supports 45 horizontally extend from the sides of the attachment bar 30 and support the tabletop surface away from the attachment bar. The addition of side supports may allow for a wider table to be supported by the flip-top mechanisms. Storage containers 50, modesty panels 55, and foot rests 60 may hang down from the attachment bar to provide additional functionality to the table. Multiple attachment bars may be secured together by a bar connector 65 and the attachment bars may include locking mechanisms 70 for securing the attachments in place. End caps 75 may also be placed in the ends of the attachment bars.

FIGS. 5*a* through 9 illustrate an example of a removable attachment bracket 25 secured to a flip-top mechanism 20. The flip-top mechanism 20 includes a top plate 85 rotatably secured to a base plate 90 about a hinge 95 on the axis of rotation 80 of the table. In the illustrated example, the axis of rotation 80 is horizontal and is partially occupied by the hinge 95 of the flip-top mechanism 20. The top plate 85 includes a substantially planar top surface 100 that is configured to be secured to the table top. The top plate is rotationally fixed to the table top about the axis of rotation 80 in that when viewed in a polar coordinate system with the axis of rotation 80 as the pole, there is a fixed angular difference θ between the table top and the top plate. The top plate 85 may also include a plurality of apertures through which a plurality of fasteners (highlighted in FIG. 5*b*) may be threaded to secure the table top to the top plate 85. When the table is in a use configuration (shown in FIGS. 5*a* and 5*b*) the attachment bracket is circumscribed by a loop 87 formed from the combination of the base plate 90 and the top plate 85, while in the storage configuration (shown in FIGS. 6 and 7) the attachment bracket 25 is not circumscribed or enclosed by the combination of the base plate 90 and the top plate 85. In the use configuration, a portion of the fasteners shown in FIG. 5*b* are located directly between the top plate and the base plate of the flip mechanism. The base plate 90 includes a leg region adapted to be rigidly secured to a table leg, and a central region 105 adapted to be removablely secured to the attachment bracket 25. The central region 105 may also include a plurality of apertures 110 through which fasteners may be threaded to secure the attachment bracket to the flip-top mechanism. Two attachment brackets may be simultaneously secured to a single central region. The base plate 90 also includes support surfaces 115 that contact and support the top plate 85 when the flip top table is in a use configuration. When the table is in a use configuration, the top plate 85 and the base plate 90 cooperate to circumscribe the attachment bracket 25 and prevent access to fasteners used to secure the attachment bracket to the central region 105 of the base plate 90.

FIGS. 10 through 13 illustrate an example of an attachment bracket 25 configured to be removably secured to both a base plate of a flip-top mechanism and an attachment bar. The attachment bracket includes a mechanism portion 120 that is configured to fit between the base plate and the top plate of the flip-top mechanism when the table is in a use configuration. The mechanism portion 120 has a width 125 and length 130 that are both substantially greater than its height 135 so as to fit into the flip-top mechanism. The mechanism portion may include recessed fastener holes 140 through which fasteners may be threaded to secure the attachment bracket to the base plate. When the flip-top mechanism is in a use configuration, the fasteners threaded through the fastener holes may not be visible or readily accessible. The attachment bracket also includes a bar portion 145 configured to interlock with an attachment bar. The bar portion includes a plurality of parallel bar protrusions 150 that extend away from the mechanism portion of the attachment bracket. In the illustrated example a large central bar protrusion 155 is constructed to be secured into the main channel of an attachment bar while smaller perimeter bar protrusions 160 are configured to be secured between the outer channels of the attachment bar. The central bar protrusion 155 may be configured to support the weight of the attachment bar and the objects supported by the attachment bar while the perimeter bar protrusions 160 are configured to prevent rotation of the attachment bar about the central bar protrusion when unequal loads are applied to the sides of the attachment bar.

FIGS. 14 through 17*b* illustrate an example of a substantially circular attachment bar 25 having attachment mounts in the form of four outer channels 165 with the pairs of channel flanges 177 surrounding a main channel 170. The outer channels 165 are configured to secure attachments to the attachment bar and due to the pairs of channel flanges 177 they have channel widths 175 that are substantially larger than their channel openings 180 so that attachments cannot be removed from the outer channels while both ends of the attachment bar are secured to attachment brackets, bar connectors, or end caps. The outer channels include end openings 185 through which attachments may be slid into or out of the outer channel. In the illustrated example, the attachment bar is constructed from a single piece of extruded metal although multiple components could be used in combination to form an attachment bar. The main channel 170 of the attachment bar is primarily defined by four sides 190 that are configured to contact the central bar protrusion of the attachment bracket.

Figure 16:
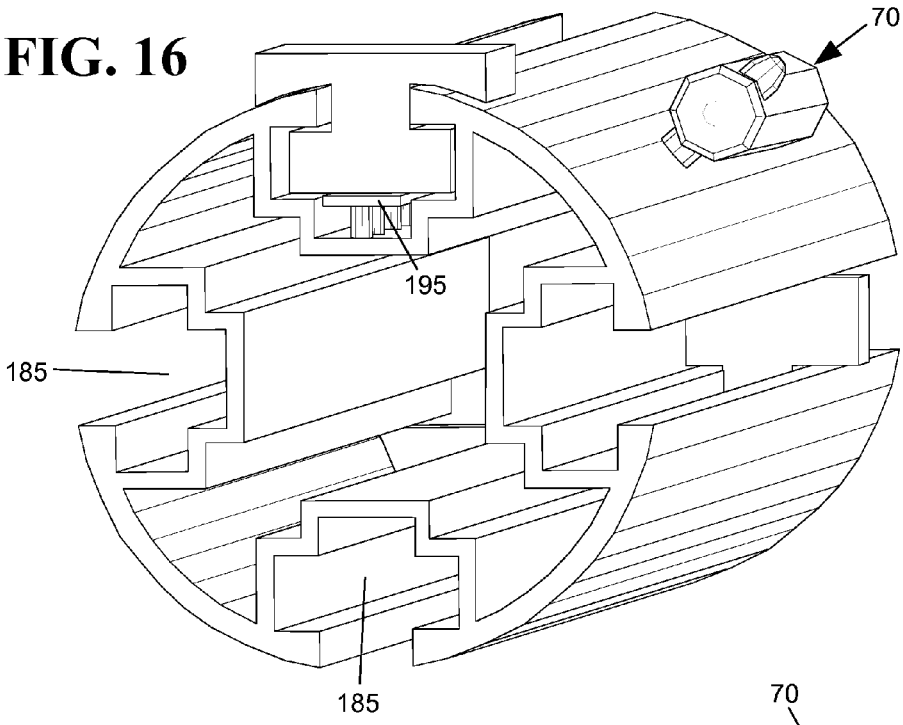
FIG. 16 illustrates a side perspective view of an attachment bar with a closed clamping mechanism.
Figure 17A:
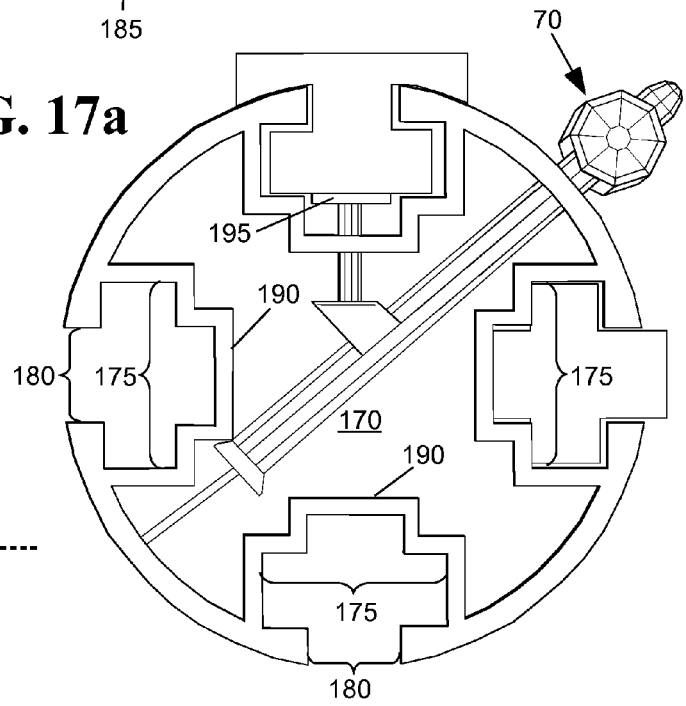
FIG. 17*a* illustrates a side elevational view of an attachment bar with a closed clamping mechanism.
Figure 17B:
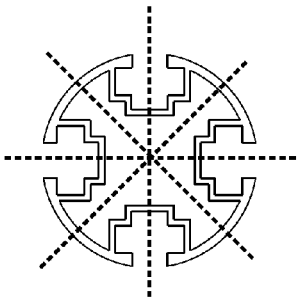
FIG. 17*b* illustrates the $D_4$ dihedral symmetry of the attachment bar shown in FIG. 17*a*.

Also shown in FIGS. 14 through 17*a* is a locking mechanism 70 structured to lock the attachments in the outer channels 165 into a fixed position. While the outer channels 165 are configured to only allow the attachments to be removed from the channel through the end openings, the attachments may be slid along the length of the outer channel while the locking mechanism 70 is disengaged. In the illustrated example, the locking mechanism includes a friction plate 195 in an outer channel 165 that may be selectively moved towards or away from the channel opening by a locking bar in the main channel 170 of the attachment bar. When the locking mechanism 70 is disengaged as shown in FIGS. 14 and 15, the friction plate 195 is located away from the channel opening and does not contact, or only minimally contacts the attachment located within the outer channels. When the locking mechanism is engaged, as shown in FIGS. 16 and 17*a*, the friction plate 195 is pressed towards the channel opening and contacts the attachment to prevent the attachment from sliding through the outer channel. Although only one example of a locking mechanism is illustrated, the inventor contemplates numerous other embodiments of locking mechanisms, such as one that clamps the sides of the attachments in the channel and a locking mechanism that is electronically controlled. FIG. 17*b* illustrates the high symmetry of the illustrated attachment bar. The attachment bar shown is dihedral and has four and only four unique axes of symmetry, thus it is $D_4$ symmetric.

Figure 18:
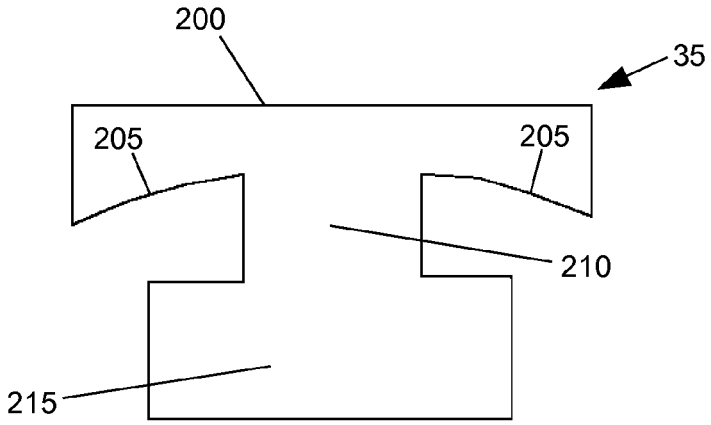
FIG. 18 shows a side elevational view of a table top supporting bar attachment.
Figure 19:
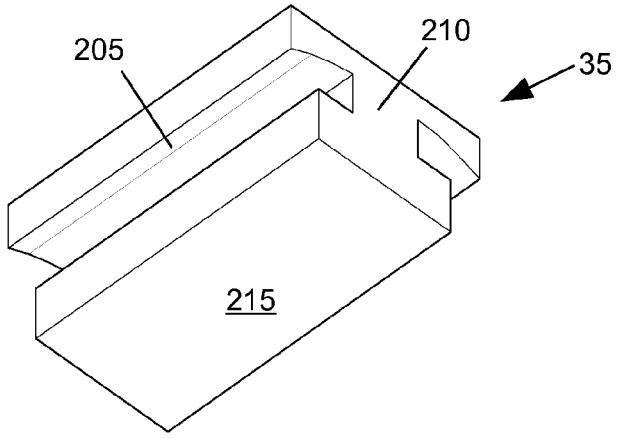
FIG. 19 shows a lower perspective view of a table top supporting bar attachment.
Figure 20:
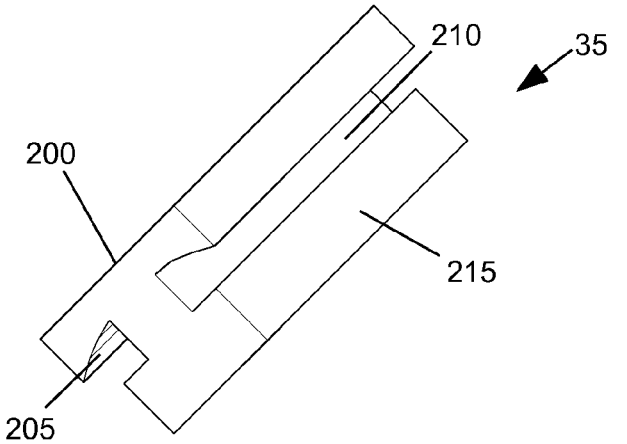
FIG. 20 shows a side perspective view of a table top supporting bar attachment.

FIGS. 18 through 20 illustrate an example of a top support 35 adapted to slide through an outer channel of an attachment bar and support a table top surface. The top support includes a substantially flat upper surface 200 configured to contact and support a table top when the table is in a use configuration. A rounded surface 205 is configured to contact the outer surface of the attachment bar and assists in supporting the flat upper surface. Like the attachments configured to be secured to the attachment bar, the top support includes a neck portion 210 having a width slightly less than the width of the channel opening and a bulb portion 215 having a width slightly less than the channel width. While the illustrated example of the bulb portion 215 is substantially rectangular, other shapes may be used based on the geometry of the outer channel. For example, the bulb portions may be cross-shaped, triangular, round, or polygonal based on the structure of the outer channel. As shown in FIG. 19, the length of the bulb region is substantially greater than the width in order to increase the rigidity of the bulb within the outer channel. While shorter lengths may be utilized (such as those illustrated in FIGS. 14 and 16), a length equal to or greater than the width of the neck portion is preferable in order to prevent the bulb from exiting through the channel opening if the bulb attachment is rotated 90 degrees.

Figure 21:
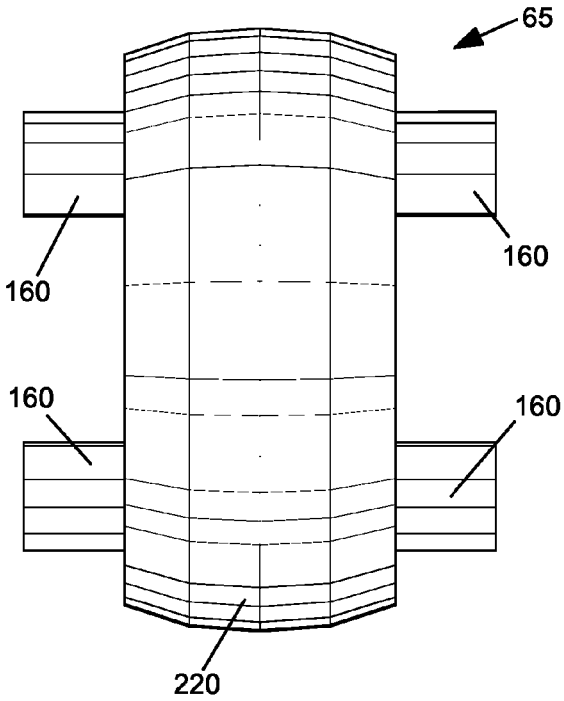
FIG. 21 shows a front elevational view of a bar joiner structured to join two attachment bars.
Figure 22:
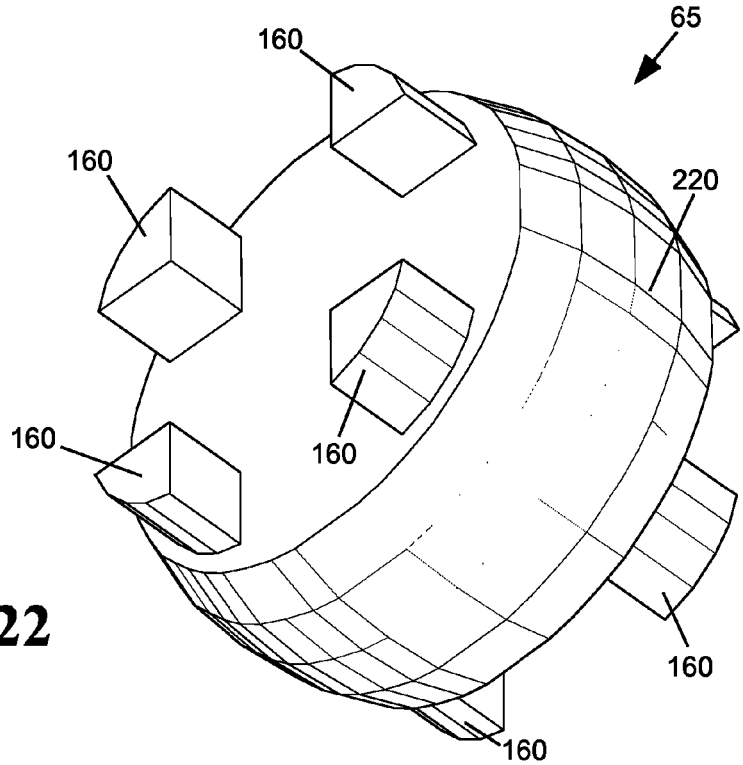
FIG. 22 shows a perspective view of a bar joiner structured to join two attachment bars.
Figure 23:
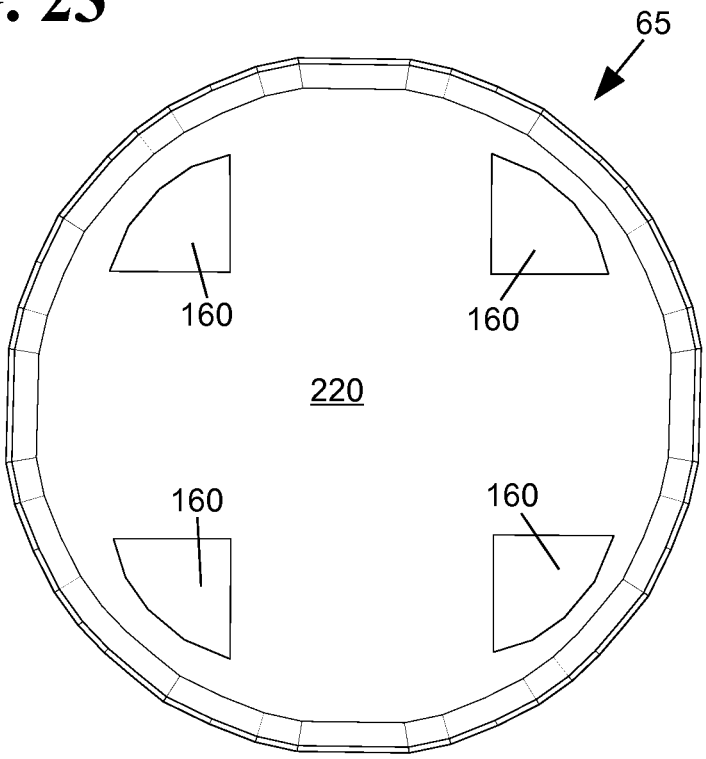
FIG. 23 shows a side elevational view of a bar joiner structured to join two attachment bars.
Figure 27:
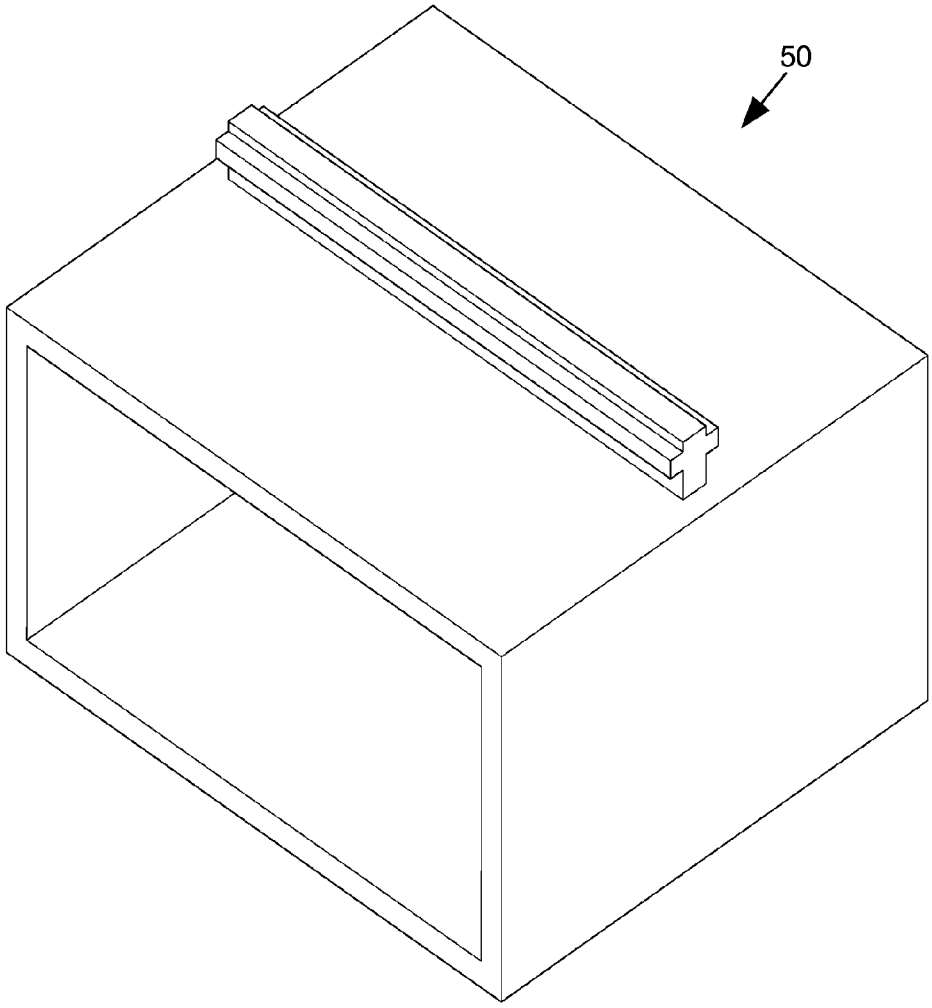
FIG. 27 shows an upper perspective view of a cabinet adapted to be secured into an attachment bar extending between table legs.
Figure 28:
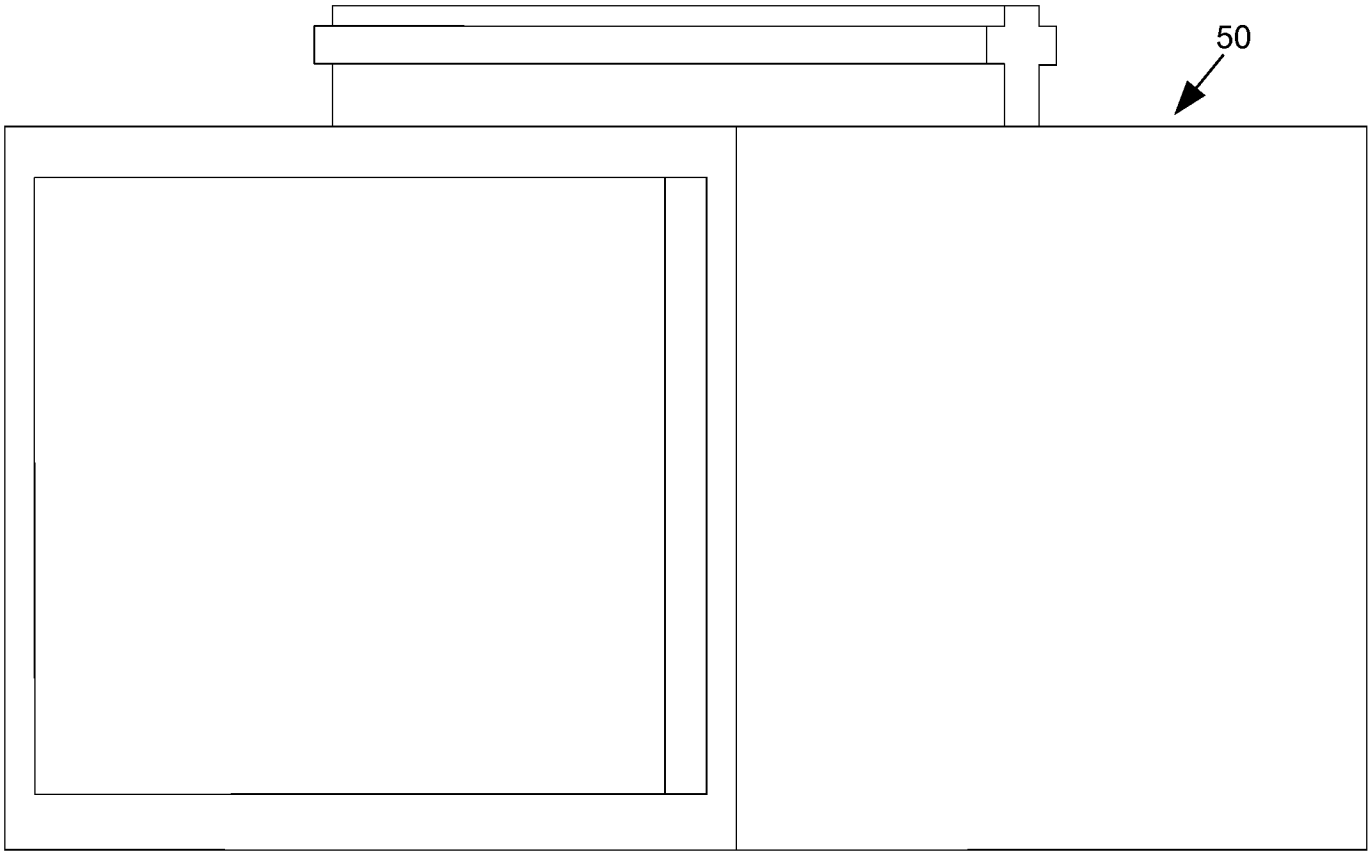
FIG. 28 shows a side perspective view of a cabinet adapted to be secured into an attachment bar extending between table legs.
Figure 29:
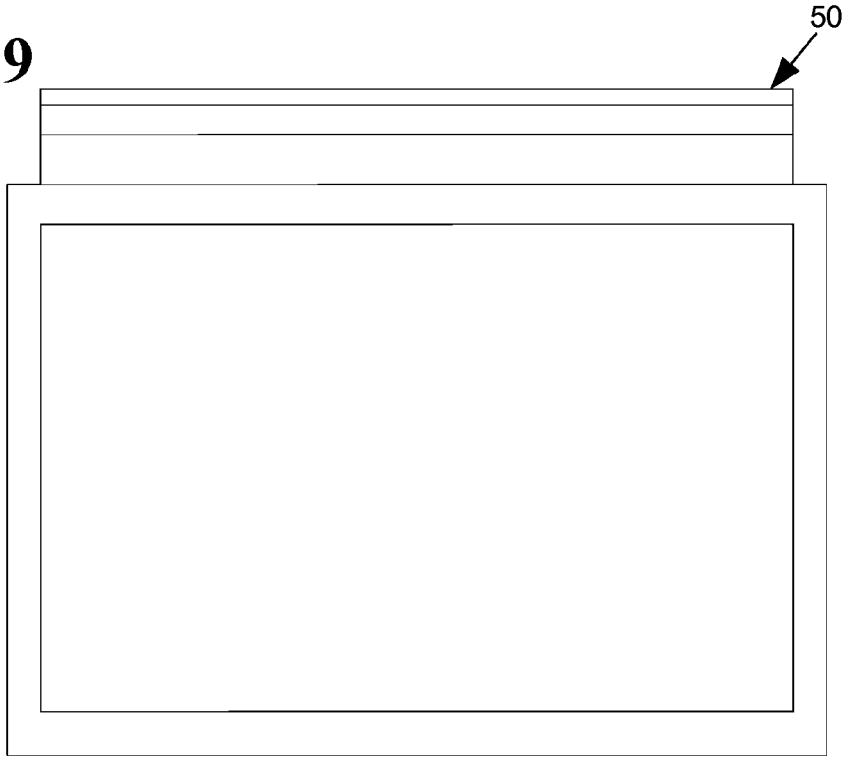
FIG. 29 shows a front elevational view of a cabinet adapted to be secured into an attachment bar extending between table legs.
Figure 30:
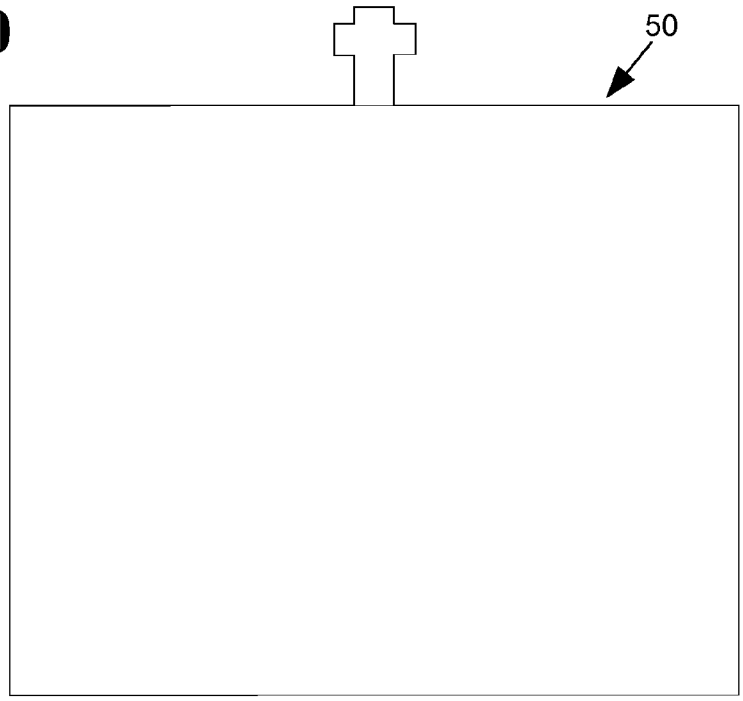
FIG. 30 shows a rear elevational view of a cabinet adapted to be secured into an attachment bar extending between table legs.

FIGS. 21 through 23 illustrate an example of a bar connector 65 for connecting two attachment bars together. By utilizing a connector bar, two smaller bars may be used to span a longer distance. The ability to lengthen an existing attachment bar offers substantial savings for customers wishing to modify their existing table systems. For example, if a customer has a 5 foot attachment bar extending between table legs and they wish to lengthen their table, it may be less expensive to add a 1 foot extension than to replace the 5 foot bar with a 6 foot bar. In addition to providing the users of the table system with savings, manufacturers of table systems are able to offer a wider variety of lengths without increasing the variety of components they produce. For example, a table manufacturer could produce only one foot attachment bar sections and use multiple bar connectors to create an attachment bar as long as was desired by the customer. In the illustrated example the bar connector 65 includes perimeter bar protrusions 160 like the attachment bracket that are configured to be secured between the outer channels of two attachment bars. The main region 220 of the bar connector has an outer shape that is substantially similar to the outer shape of the attachment bar. In the example, the main region 220 is substantially cylindrical like the attachment bar. While only perimeter bar protrusions are shown in the illustrated example, the bar connector may also include central bar protrusions like the attachment bracket. Alternatively, the bar connector may only have central bar protrusions. In yet another embodiment, the bar connector may include outer channels aligned with the outer channels of the attachment bars through which attachments could slide.

FIGS. 24 through 26 illustrate an example of a modesty panel 55 configured to be secured to an attachment bar. Like the top support, the modesty panel includes a neck portion 210 that is slightly thinner than the opening of the outer channel and a bulb portion 215 that is slightly thinner than the outer channel. In the illustrated example, the bulb is cross shaped. Although the modesty panel shown has a width substantially equal to the neck portion, thinner, or thicker modesty panels may be utilized.

Figure 31:
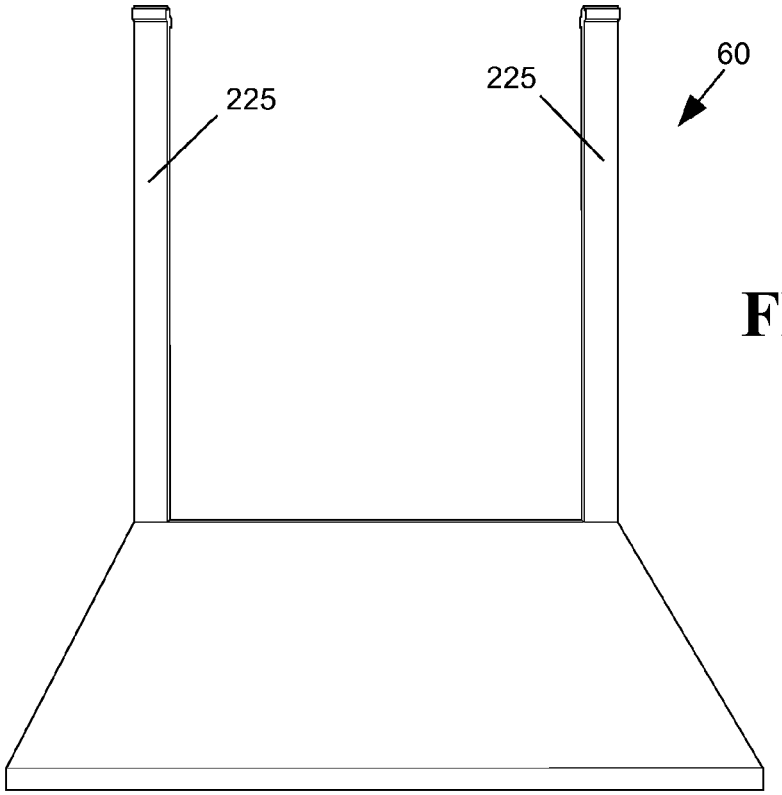
FIG. 31 shows a front perspective of a foot rest adapted to be secured into an attachment bar extending between table legs.
Figure 32:
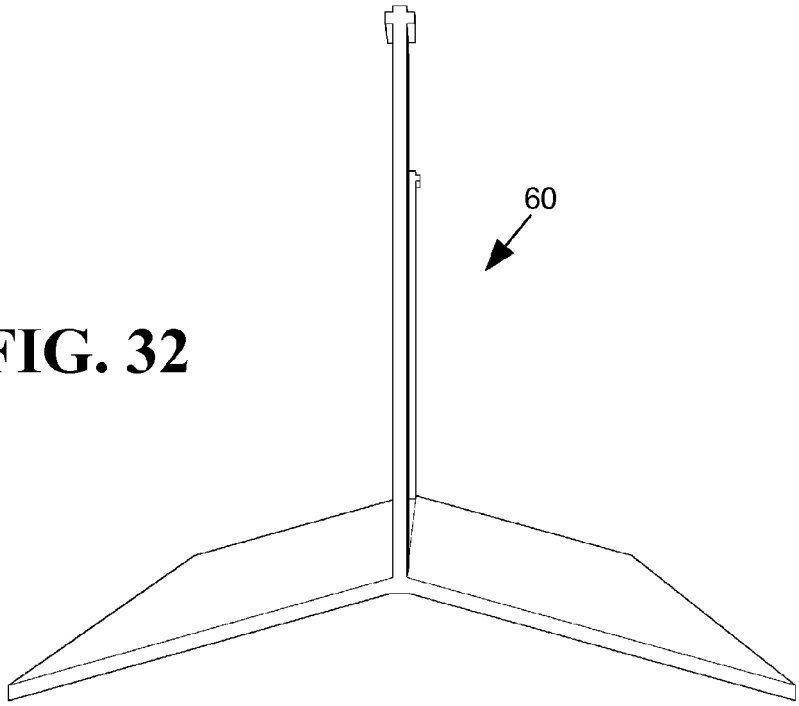
FIG. 32 shows a side perspective of a foot rest adapted to be secured into an attachment bar extending between table legs.

FIGS. 27 through 30 illustrate an example of a storage container 50 adapted to be secured to the lower outer channel of an attachment bar. Although only one neck and bulb assembly is shown, if the storage container is to carry substantial loads, the storage container may be secured in the lower outer channel and both of the side outer channels of the attachment bracket. Utilizing more than one outer channel may also increase the stability of the storage container. FIGS. 31 and 32 illustrate an example of a foot rest 60 that is configured to be secured to an attachment bar. As shown, two distinct attachment portions 225 of the foot rest are designed to be secured to the attachment bar. In an exemplary embodiment of the invention, a modesty panel or storage container may be secured between the two attachment portions of the foot rest.

Figure 33:
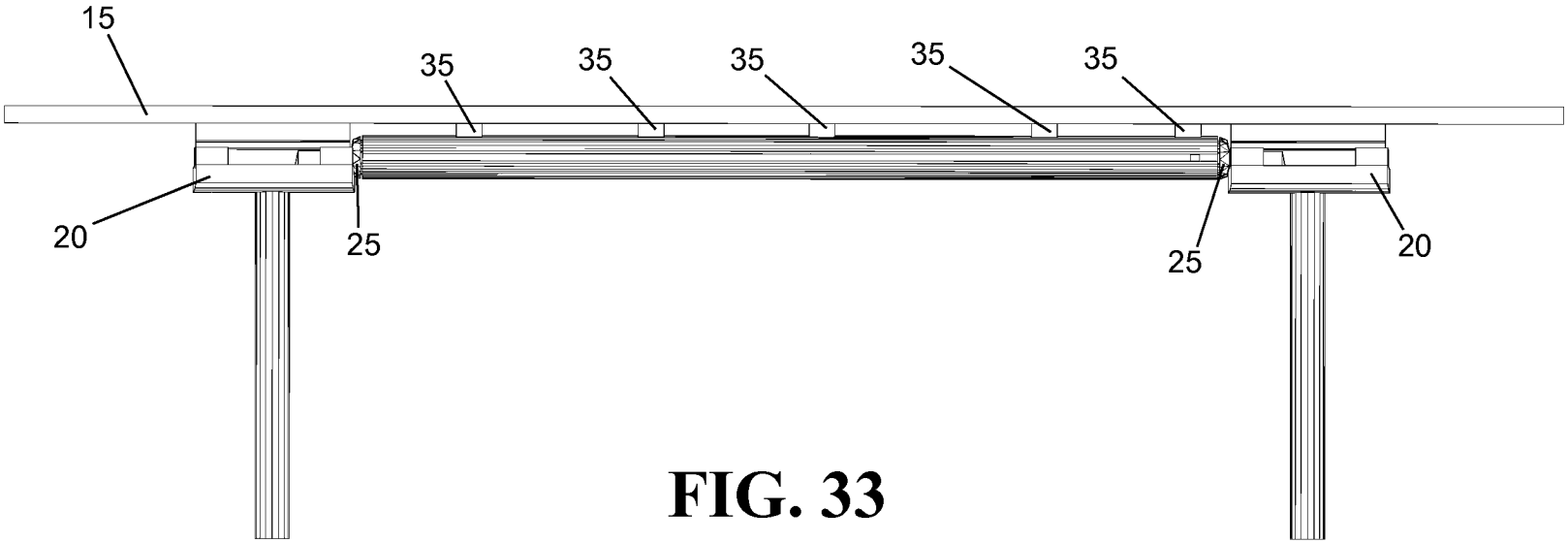
FIG. 33 shows a side elevational view of an attachment bar extending between two flip-top table mechanisms and multiple attachments secured to the attachment bar supporting a table top surface.
Figure 34:
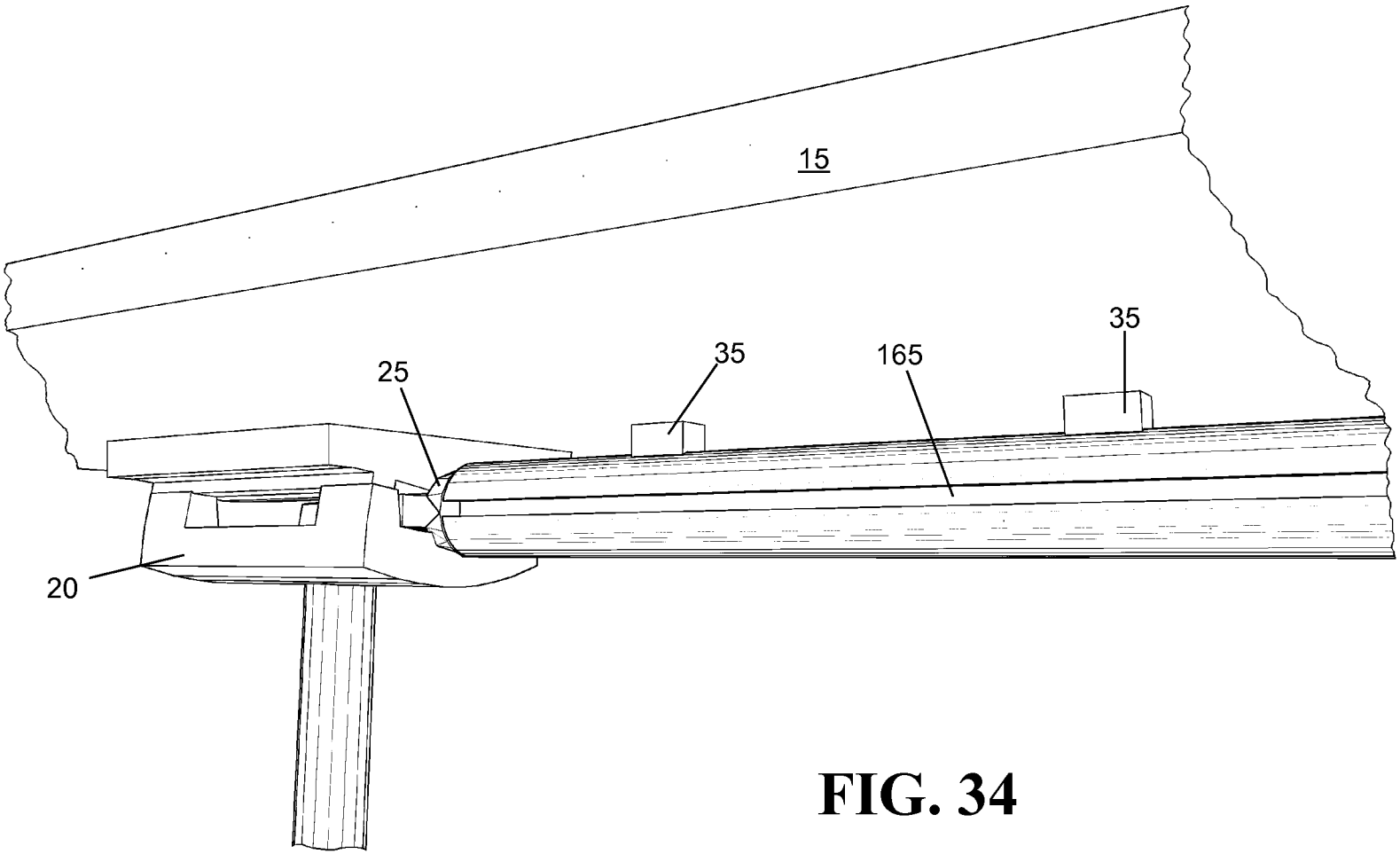
FIG. 34 shows a partial perspective view of multiple attachments on an attachment bar supporting a table top surface.

FIGS. 33 and 34 illustrate an example of a table system in a use configuration. An attachment bar 30 is connected to attachment brackets 25 and extends between flip-top mechanisms 20. Top supports 35 are secured in an outer channel 165 of the attachment bar 30 and act to support the weight of the table top 15.

FIGS. 35 through 44 illustrate examples of single table legs 10 with single flip-top mechanisms 20 supporting single table tops 15. FIGS. 35 through 41 illustrate table systems with a single attachment bracket 25 and attachment bar 30 secured to the flip-top mechanism, while in FIGS. 42 through 44, two attachment brackets 25 are secured to a single flip-top mechanism 20. In FIGS. 35 through 43 the proximate side supports 40 include horizontal supports 230 extending from the outer channels of the attachment bars to rotors 235 that rotates about the axis of rotation 80. In the illustrated example the attachment bar 30 extends away from the flip mechanism parallel, and distant from, the axis of rotation 80. A single axis of rotation passes through the rotors of the proximate side supports 40 and the hinges of the flip-top mechanisms 20. From the rotor 235, a rotating support 240 extends to the table top 15. Adjacent to the table top 15, the rotating support 240 has a table strap 245 that extends perpendicular to the attachment bar 30. The table strap 245 acts to support the weight of the table top 15 at positions away from the attachment bar 30 and allows for a wider table top to be utilized than could otherwise be supported without the table strap. Additionally, the table strap helps to support some of the weight of the table top when the table is in a storage configuration.

Figure 35:
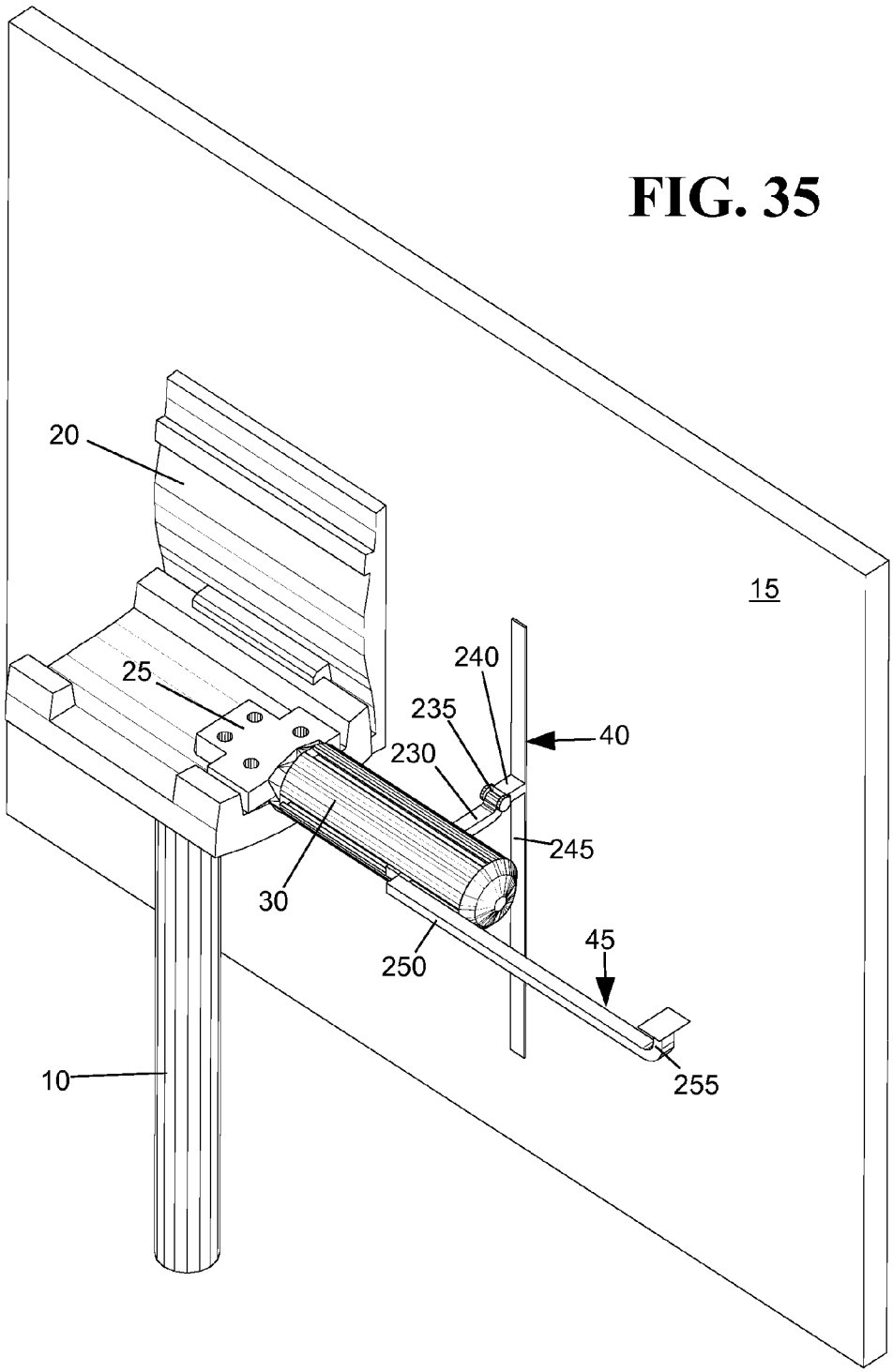
FIG. 35 illustrates an upper perspective of a flip-top table in a storage configuration wherein an attachment bar is secured to the flip-top mechanism and hinged supports extend horizontally from the attachment bar.
Figure 36:
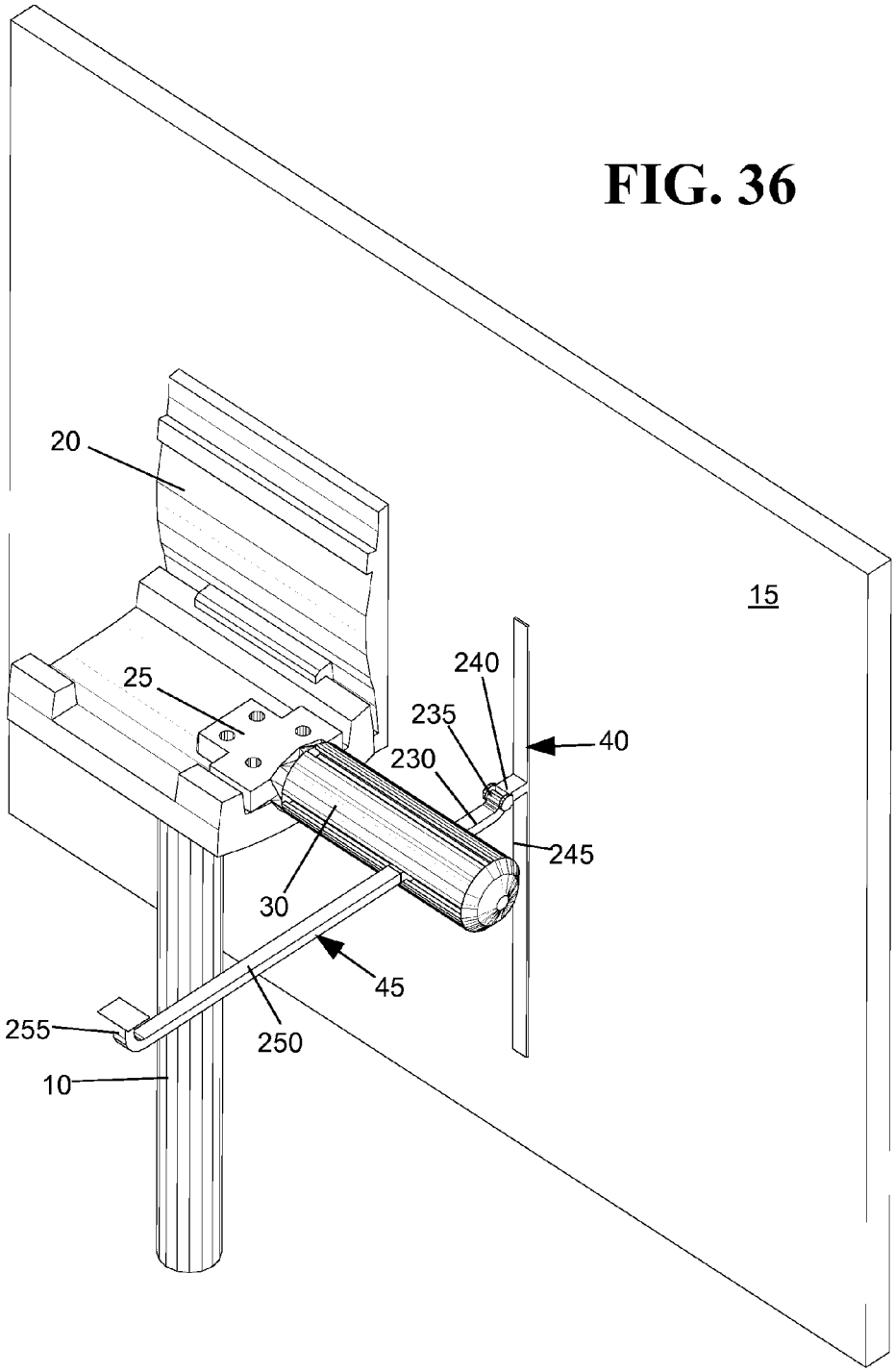
FIG. 36 illustrates an upper perspective of a flip-top table in a partial storage configuration wherein an attachment bar is secured to the flip-top mechanism and hinged supports extend horizontally from the attachment bar.
Figure 37:
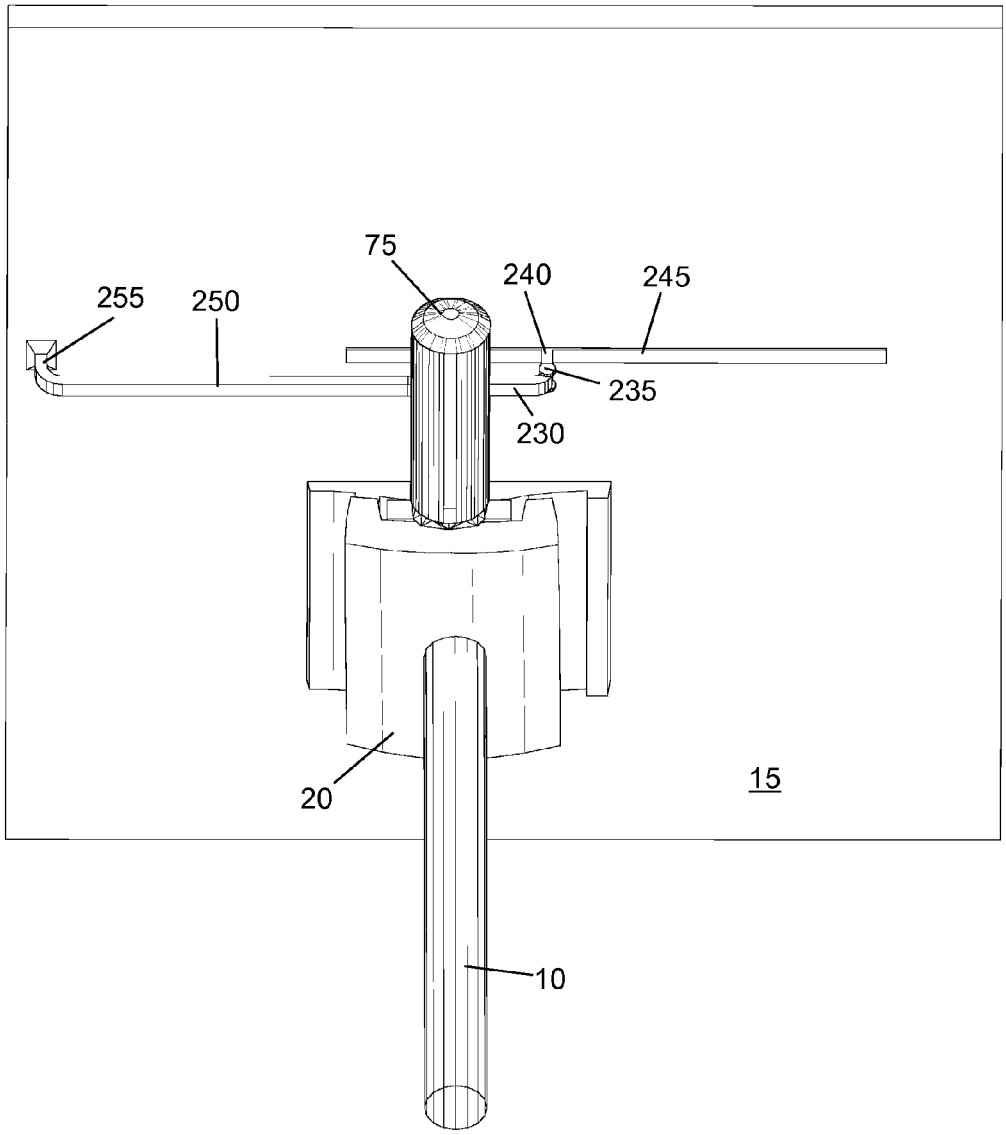
FIG. 37 illustrates an upper perspective of a flip-top table in a use configuration wherein an attachment bar is secured to the flip-top mechanism and hinged supports extend horizontally from the attachment bar.
Figure 38:
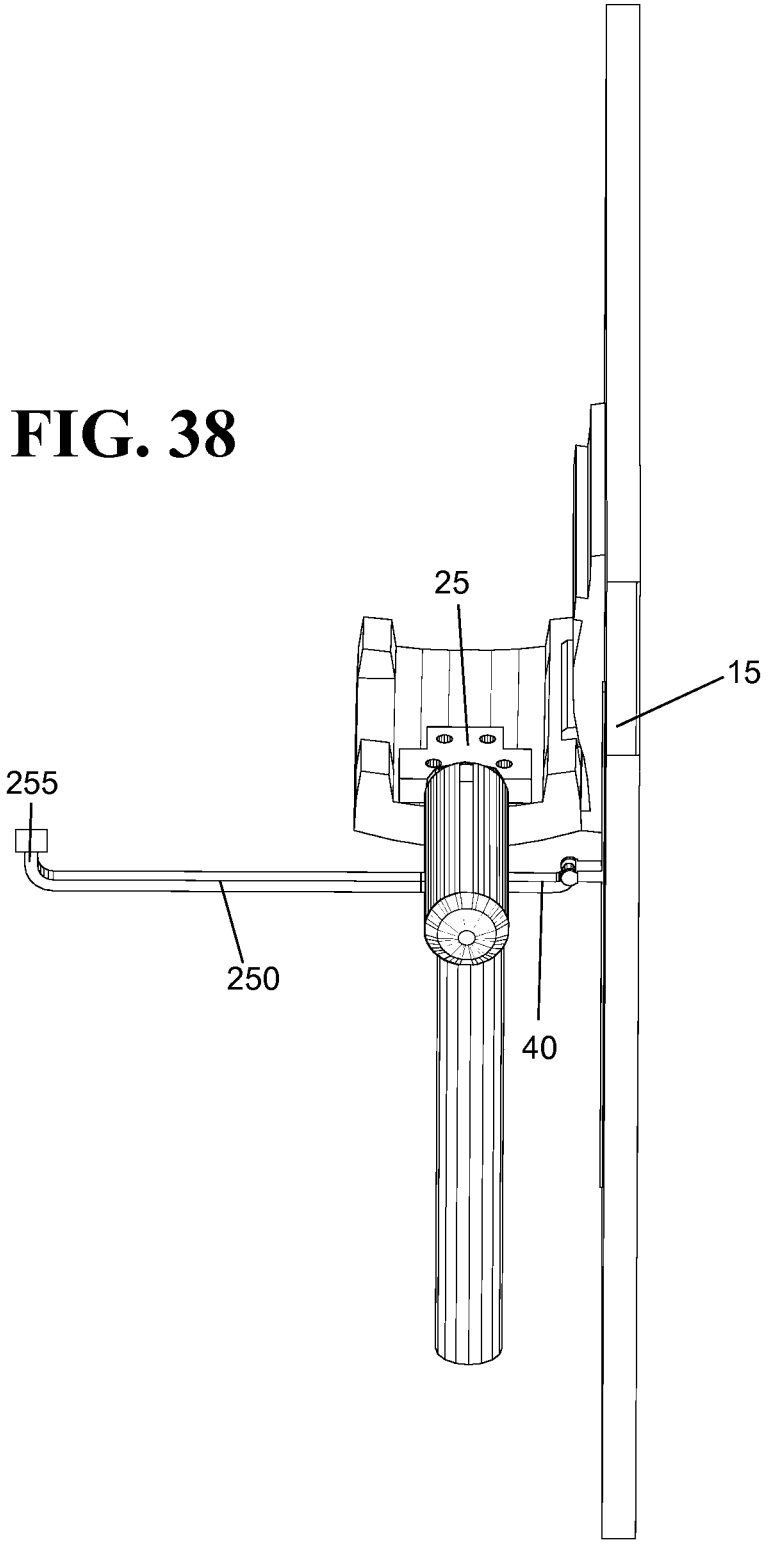
FIG. 38 illustrates a side perspective of a flip-top table in a partial storage configuration wherein an attachment bar is secured to the flip-top mechanism and hinged supports extend horizontally from the attachment bar.
Figure 39:
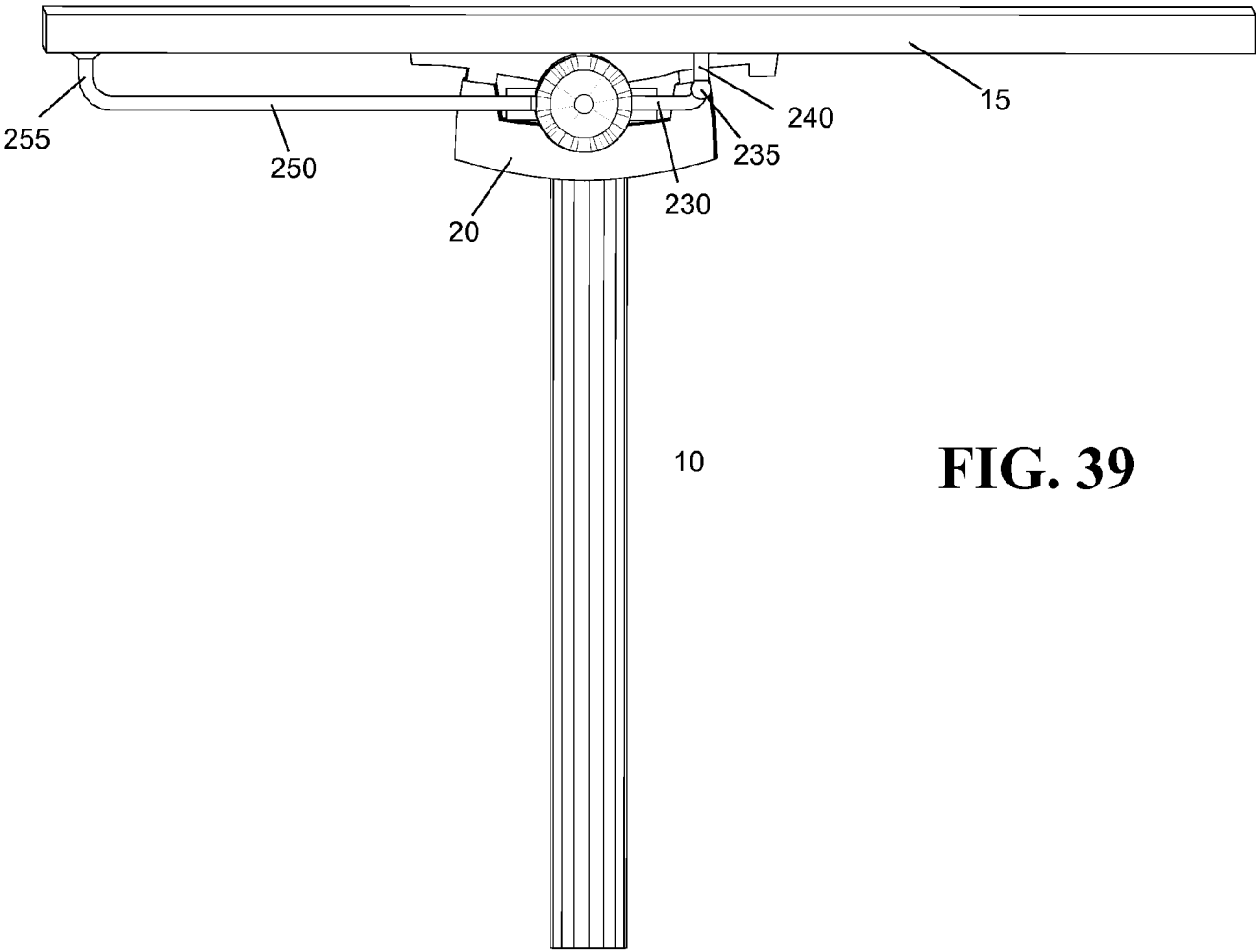
FIG. 39 illustrates a side elevational view of a flip-top table in a use configuration wherein an attachment bar is secured to the flip-top mechanism and hinged supports extend horizontally from the attachment bar.
Figure 40:
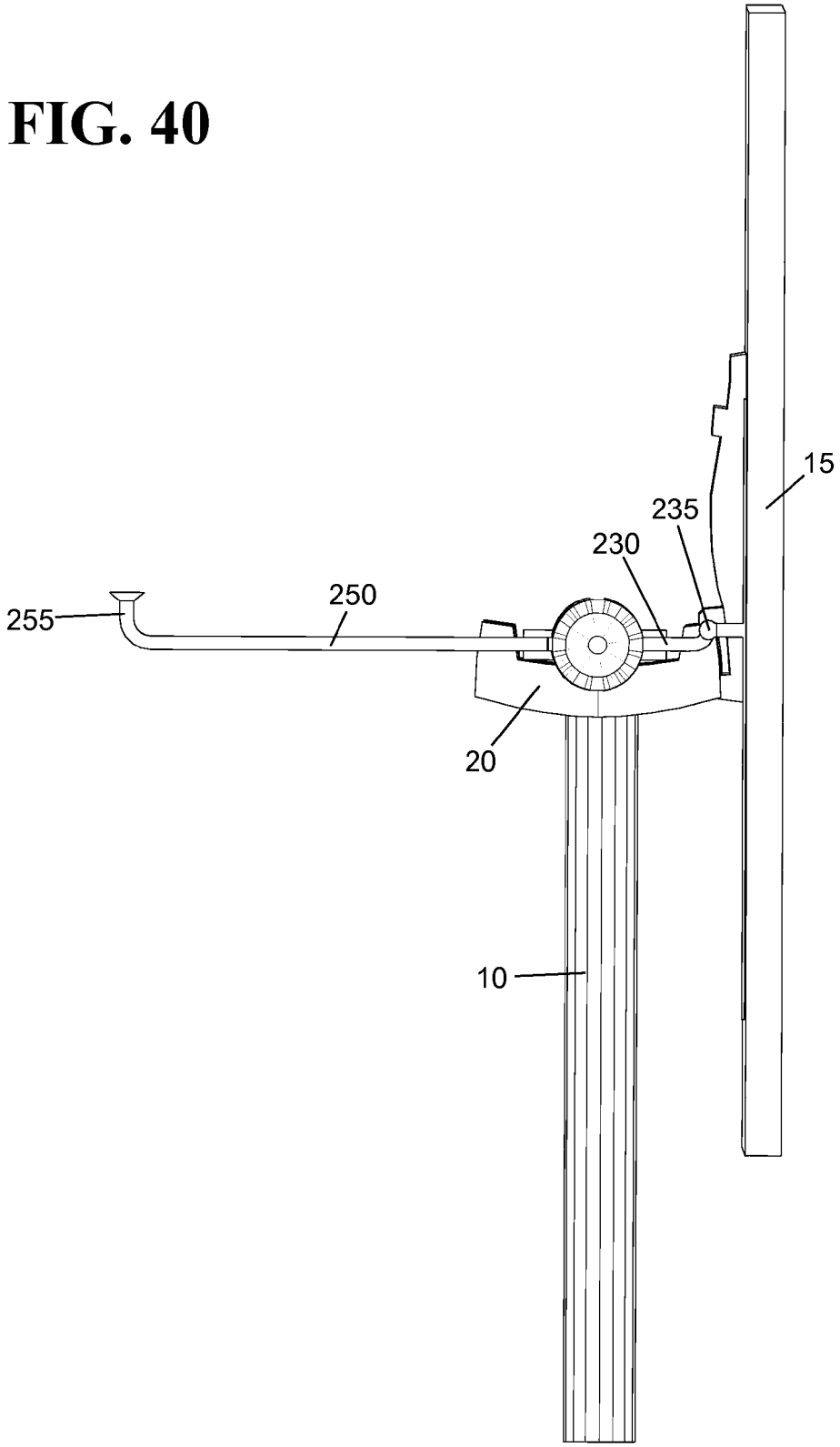
FIG. 40 illustrates a side elevational view of a flip-top table in a partial storage configuration wherein an attachment bar is secured to the flip-top mechanism and hinged supports extend horizontally from the attachment bar.
Figure 41:
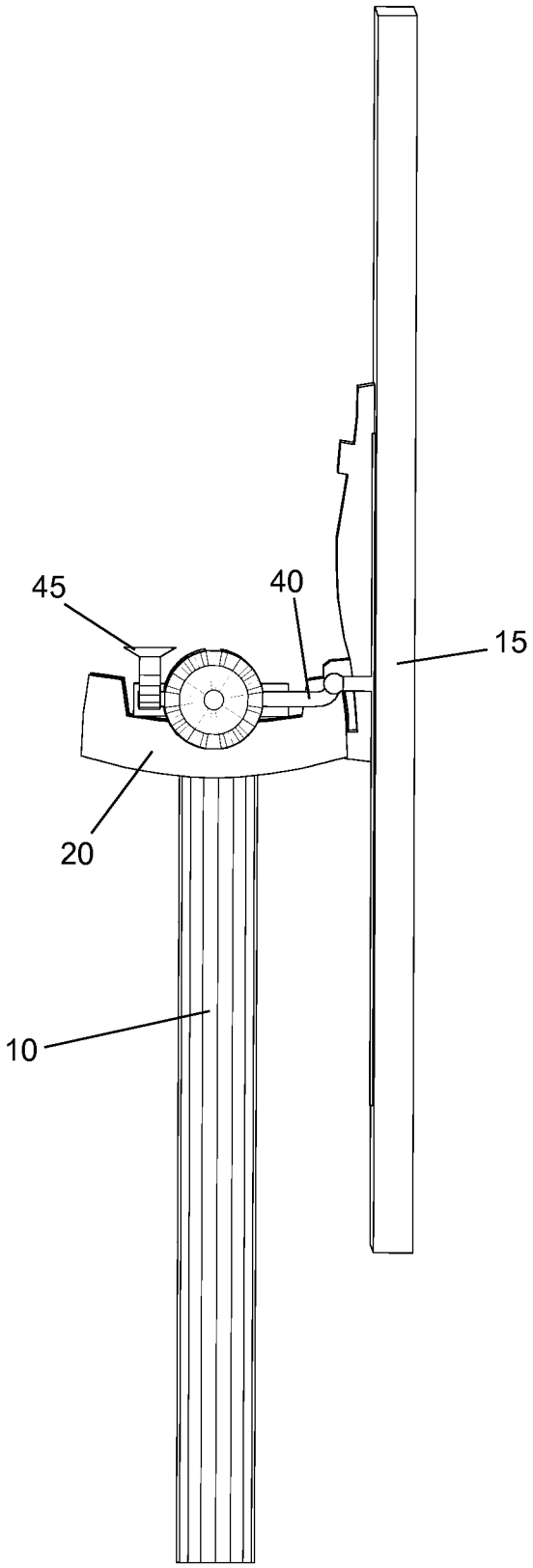
FIG. 41 illustrates a side elevational view of a flip-top table in a storage configuration wherein an attachment bar is secured to the flip-top mechanism and hinged supports extend horizontally from the attachment bar, wherein two table top supports are secured to each attachment bar.
Figure 42:
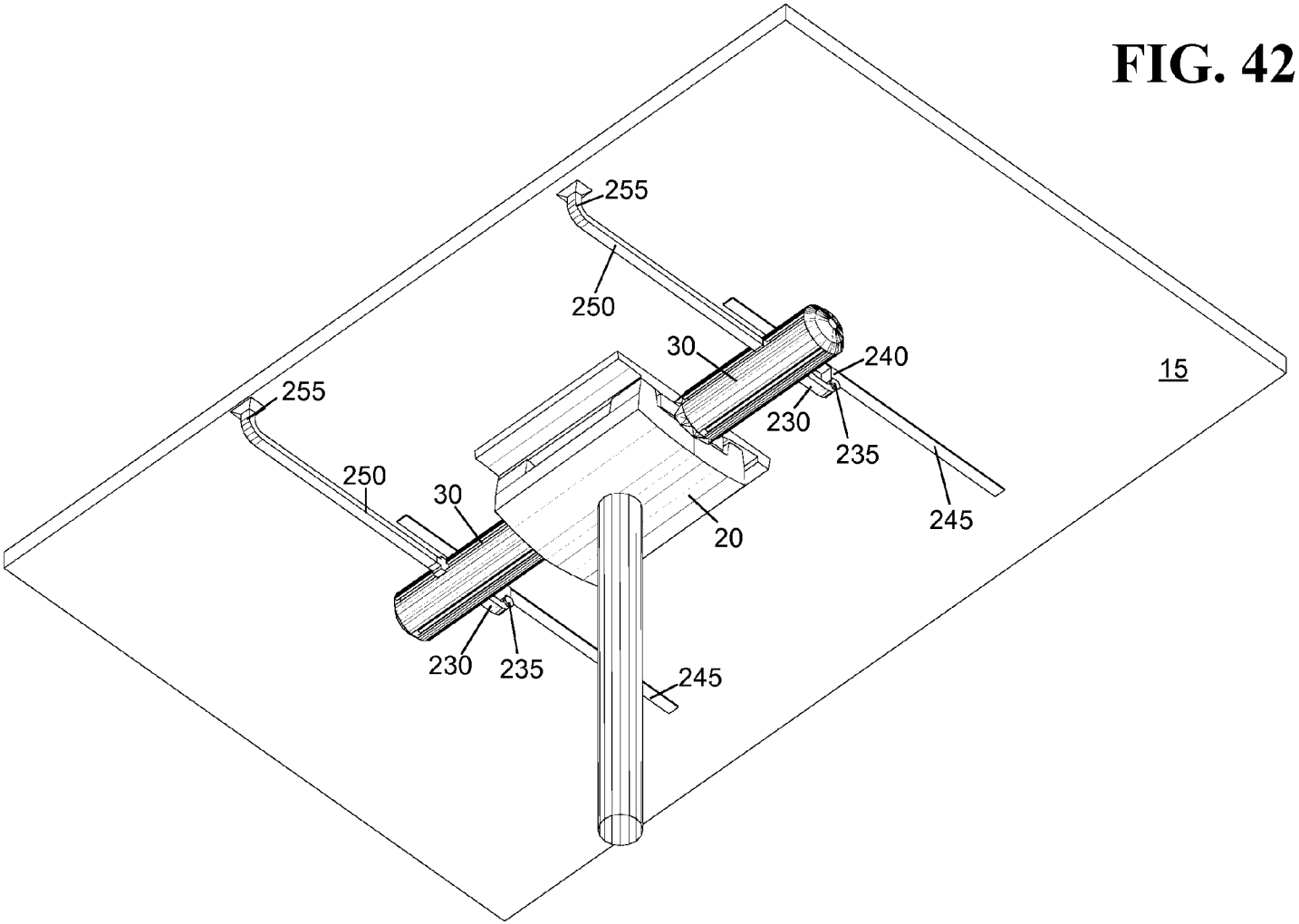
FIG. 42 illustrates a first lower perspective view of a flip-top table having two attachment bars extending away from a single flip-top mechanism, wherein two table top supports are secured to each attachment bar.
Figure 43:
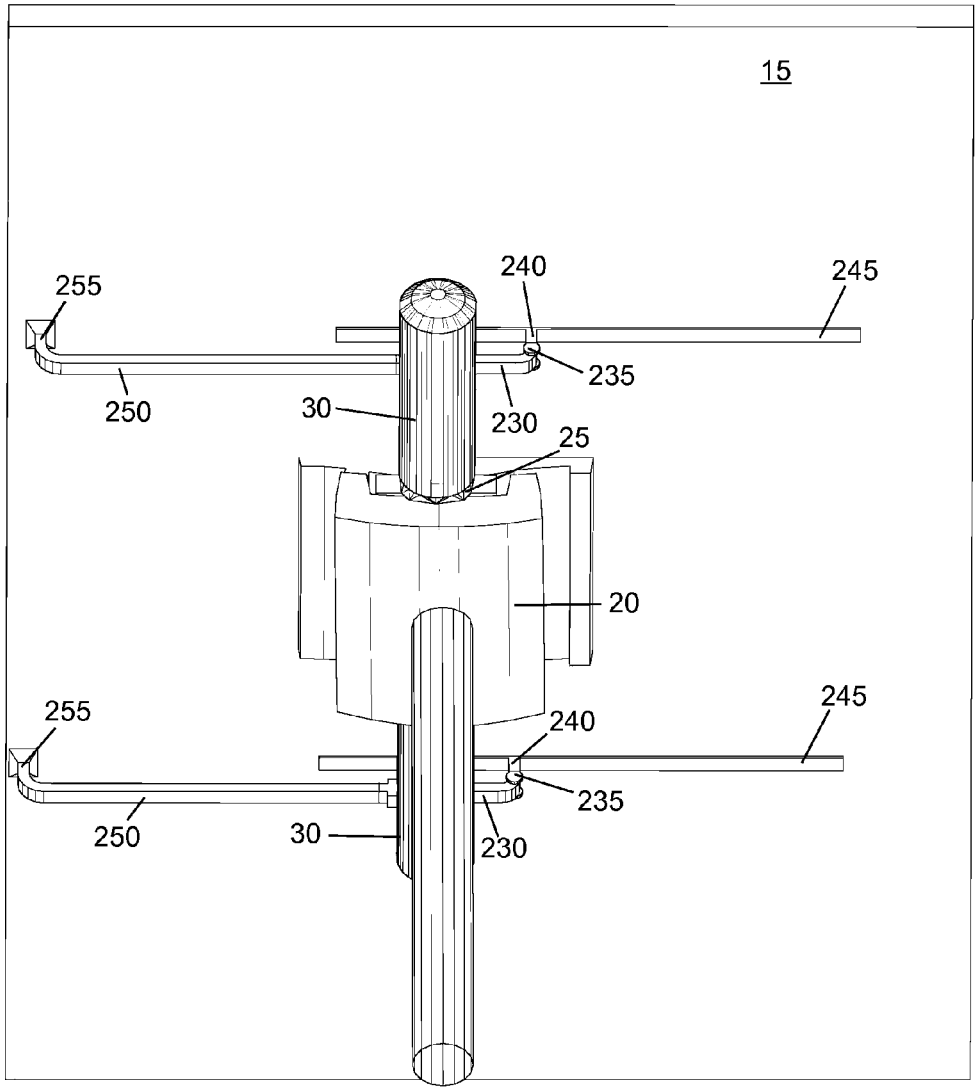
FIG. 43 illustrates a second lower perspective view of a flip-top table having two attachment bars extending away from a single flip-top mechanism, wherein two table top supports are secured to each attachment bar.

The distant side supports 45 are secured in outer channels of the attachment bars and the hinged lateral sections 250 of the distant side supports rotate in a plane perpendicular to the axis of rotation of the table top. The hinged lateral sections 250 extend to vertical table supports 255 that act to support the weight of the table top when the table is in a use configuration. FIGS. 35 and 41 illustrate examples of distant side supports 45 that have been rotated so that the hinged lateral sections are parallel to and adjacent to the attachment bars 30. By rotating the distant side supports 45, the total width of the table system in the storage configuration is substantially decreased and multiple tables may be stored in close proximity to each other. FIGS. 36 and 40 illustrate tables with distant side supports extending away from the attachment bars and FIGS. 35 and 41 illustrate the space savings realized when the distant side supports are rotated close to the attachment bars. The hinged lateral sections 250 may also include latches to prevent unintentional rotation. Like the proximate side supports, the distant side supports help to support the weight of the table top in the use configuration and increase the width of table that may be supported by the flip-top mechanism.

Figure 44:
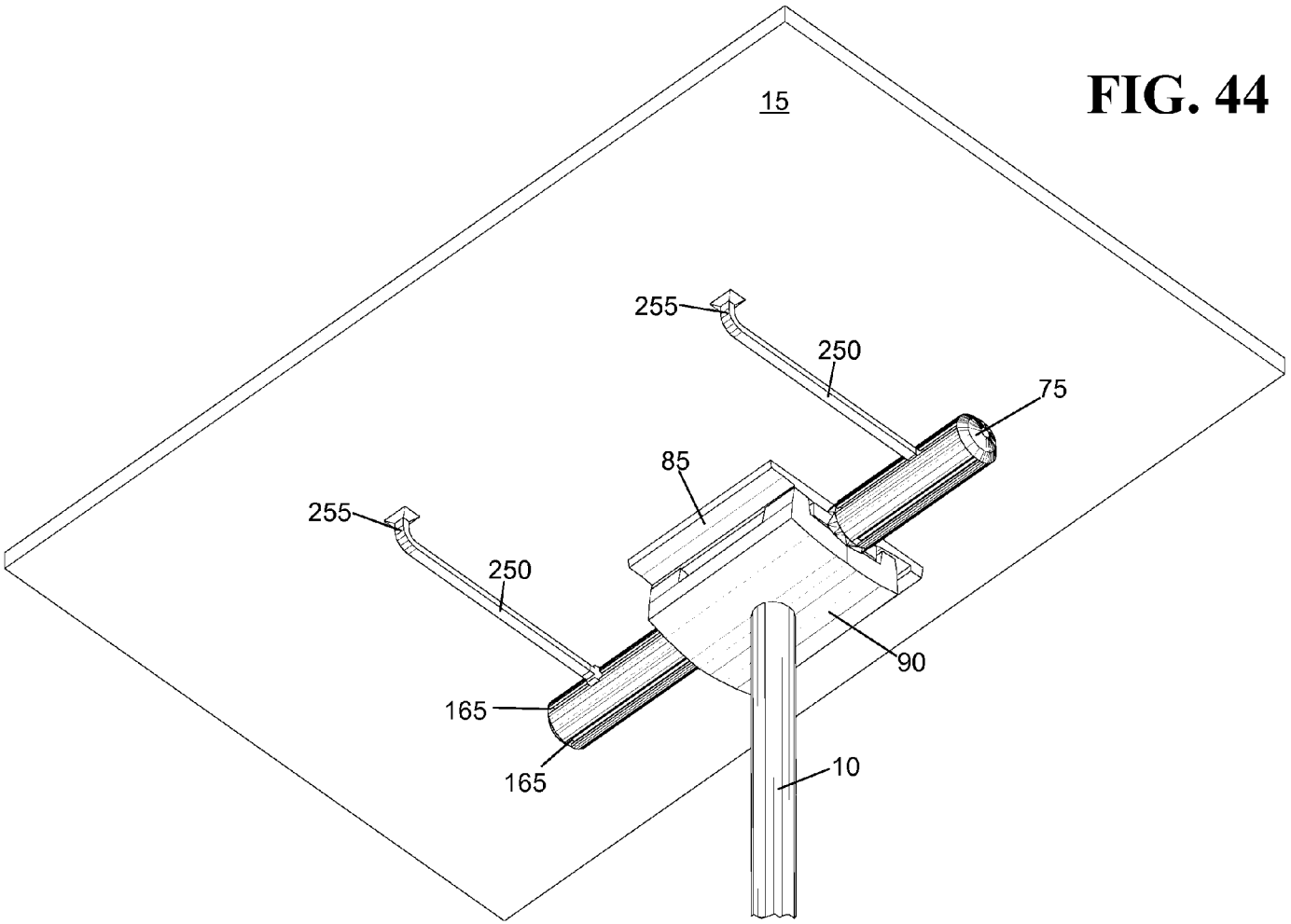
FIG. 44 illustrates a lower view of a flip-top table having two attachment bars extending away from a single flip-top mechanism, wherein a single top support is secured to each attachment bar.

FIG. 44 illustrates an example of a table system with a single table leg 10 supporting a single flip-top mechanism 20 with two attachment bars 30 extending from the flip-top mechanism. The flip-top mechanism 20 is substantially off center of the table top 15 and distant side supports 45 are used to balance and support the off center table top.

The components of the system may be constructed from a wide variety of materials such as plastics, metals, natural materials, and composite materials. Materials contemplated by the inventor include molded glass, fiberglass, nylon, glass material, stamped steel, stamped aluminum, carbon/nylon reinforced textile sheets, amarid, polyester, and carbon fiber. For components created by an extrusion process, the resins contemplated by the inventor include epoxy, unsaturated polyester, urethane acrylate, vinyl ester, phenol, polyurethane, a thermoplastic resin, nylon 6, nylon 66, nylon 12, PBT, PET, polycarbonate, polyacetal, polyphenylene sulfide, polyether ether ketone, polyether sulfide, polyphenylene oxide, modified polyphenylene oxide, polypropylene, and polyvinyl chloride, ethylene-vinyl acetate copolymer, polystyrene, acrylonitrile-butadiene-styrene copolymers (ABS), 6, 11, 12, 6-6 and 6-10 polyamides, poly(ether amide) sequenced copolymer, fluorinated polymers, polysulfone, polyethersulfone, polycarbonate, polyetheretherketone, polyphenylene sulfur, polyetherimide, and polyphenylene ether.

The inventors contemplate several alterations and improvements to the disclosed invention. Although various embodiments of the present invention have been described, those skilled in the art will recognize more modifications that may be made that would nonetheless fall within the scope of the present invention. Therefore, the present invention should not be limited to the apparatus described. Instead, the scope of the present invention should be consistent with the invention claimed below.

We claim:

1. A support and attachment system for a flip-top table with a table top surface rotatable relative to a table leg about a horizontal axis of rotation, the system comprising:

a flip mechanism having a first portion rotationally fixed with the table top surface about the horizontal axis of rotation, the first portion rotatable about the horizontal axis of rotation between a use configuration wherein the table top surface is horizontal and a storage configuration wherein the table top surface is substantially vertical, a second portion rotationally fixed with the table leg about the horizontal axis of rotation, and a third portion in the horizontal axis of rotation;

a bracket secured to the flip mechanism with a fastener, the fastener having a located portion located between the table top surface and the second portion of the flip mechanism when the flip mechanism is in the use configuration; and a bar secured to the bracket, having a length extending from the flip mechanism parallel to the horizontal axis of rotation, located distant from the horizontal axis of rotation, the bar having a first attachment mount securing a first item to the bar.

2. The system of claim 1 wherein the located portion of the fastener is located directly between the first and second portions of the flip mechanism when the flip mechanism is in the use configuration.

3. The system of claim 1 wherein the first and second portions of the flip top mechanism form a loop when the flip top mechanism is in the use configuration, the loop circumscribing the located portion of the fastener.

4. The system of claim 1 wherein the first attachment mount extends the length of the bar parallel to the horizontal axis of rotation, and a second item is secured to the bar at the attachment mount, the second item having a bulbous portion located within the first attachment mount.

5. The system of claim 1 wherein the first attachment mount includes a slot having an opening with a length substantially equal to the length of the bar and a width of a first distance; and a bulbous element secured to the item, the bulbous element secured within the slot, the bulbous element having a width greater than the first distance to prevent the bulbous element from passing through the opening of the slot.

6. The system of claim 1 wherein the first attachment mount includes a channel extending the a first length of the bar, the channel having a first opening extending the first length with a first width;

a bulbous element including a bulb portion secured to a neck portion, the bulbous element located within the channel, wherein the width of the bulb portion is greater than the first width, and the width of the neck portion is less than the first width;

the item directly contacting and rigidly secured to the bulbous element.

7. The system of claim 6 wherein the channel includes a second opening perpendicular to the first opening at an end of the bar, the second opening having an opening width greater than the first width.

8. The system of claim 1 wherein the bar is $D_4$ symmetric.

9. The system of claim 1 further comprising the bar including a second attachment mount wherein the first attachment mount includes a first channel in the bar extending the length of the bar and, a first opening to the first channel bounded by a first pair of channel flanges;

the second attachment mount includes a second channel in the attachment bar extending the length of the attachment bar parallel to the first channel, and a second opening to the second channel bounded by a second pair of channel flanges.

10. The system of claim 9 wherein the first channel is located directly above the second channel.

11. The system of claim 10 wherein the item is a top support for supporting the table top surface, and a modesty panel is secured to the second channel.

12. The system of claim 1 wherein the first attachment mount is a first channel extending the length of the bar, the item secured to the first attachment mount is a side support horizontally extending away from the bar perpendicular to the length of the bar, and the side support includes a top support portion for supporting the table top surface.

13. A support and attachment system for a flip-top table with a table top surface rotatable relative to a first table leg and a second table legs about a horizontal axis of rotation, the system comprising:

a first flip mechanism and a second flip mechanism, each flip mechanism having a first portion rotationally fixed with the table top surface about the horizontal axis of rotation, the first portion rotatable about the horizontal axis of rotation between a use configuration wherein the table top surface is horizontal and a storage configuration wherein the table top surface is substantially vertical, a second portion rigidly secured to one of the table legs, and a hinge located on the horizontal axis of rotation connecting to both the first portion and the second portion;

a first attachment bracket secured to the second portion of the first flip mechanism with a first fastener;

a second attachment bracket secured to the second portion of the second flip mechanism with a second fastener; and a bar extending from the first attachment bracket to the second attachment bracket.

14. The system of claim 13 wherein the attachment bar includes a first attachment channel extending from the first attachment bracket to the second attachment bracket.

15. The system of claim 14 further comprising a first utility attachment having a portion secured in the first attachment channel and slidable in the first attachment channel from the first attachment bracket to the second attachment bracket.

16. The system of claim 15 wherein the first utility attachment extends from the attachment bar towards the table top surface.

17. The system of claim 14 further comprising the attachment bar including a first section connected to a second section through a bar connector, wherein each section includes a portion of the first attachment channel.

18. The system of claim 14 wherein the attachment bar includes a second attachment channel extending from the first attachment bracket to the second attachment bracket, the second attachment channel located directly above the first attachment channel.

19. The system of claim 14 wherein the first attachment bracket includes a mechanism portion with a width, a height, and a length, both the width and length being substantially greater than the height;

the first fastener contacting the mechanism portion;

a bar portion, located between, and secured to both the mechanism portion and a plurality of parallel protrusions; and the plurality of parallel protrusions located within the bar.

20. The system of claim 13 further comprising a third attachment bracket secured to the second portion of the second flip mechanism with a third fastener.

* * * * *